US012799759B2

(12) United States Patent
Park

(10) Patent No.: US 12,799,759 B2
(45) Date of Patent: Nov. 17, 2026

(54) COMPOSITE MATERIAL REINFORCEMENT DEVICE FOR BOX-TYPE CONCRETE STRUCTURE AND METHOD OF CONSTRUCTING THE SAME

(71) Applicant: KYUNGPOOK NATIONAL UNIVERSITY INDUSTRY-ACADEMIC COOPERATION FOUNDATION, Daegu (KR)

(72) Inventor: Choonwook Park, Daegu (KR)

(73) Assignee: KYUNGPOOK NATIONAL UNIVERSITY INDUSTRY-ACADEMIC COOPERATION FOUNDATION, Daegu (KR)

( * ) Notice: Subject to any disclaimer, the term of this patent is extended or adjusted under 35 U.S.C. 154(b) by 268 days.

(21) Appl. No.: 18/685,232

(22) PCT Filed: Aug. 12, 2022

(86) PCT No.: PCT/KR2022/012064
§ 371 (c)(1),
(2) Date: Feb. 21, 2024

(87) PCT Pub. No.: WO2023/033403
PCT Pub. Date: Mar. 9, 2023

(65) Prior Publication Data

US 2024/0426125 A1 Dec. 26, 2024

(30) Foreign Application Priority Data

Aug. 31, 2021 (KR) ..... 10-2021-0115862

(51) Int. Cl.
*E04B 1/348* (2006.01)
*E04H 9/02* (2006.01)
(Continued)

(52) U.S. Cl.
CPC ..... *E04H 9/021* (2013.01); *E04H 9/027* (2013.01); *E02D 29/00* (2013.01); *E02D 29/10* (2013.01); *E04B 1/34384* (2013.01); *E04B 1/348* (2013.01)

(58) Field of Classification Search
CPC ..... E04H 9/021; E04H 9/027; E02D 29/00; E02D 29/045; E04B 1/348;
(Continued)

(56) References Cited

U.S. PATENT DOCUMENTS 1,247,250 A * 11/1917 Field ..... B23K 35/224 29/455.1
2,333,343 A * 11/1943 Sendzimir ..... E04C 2/3405 52/783.17
(Continued)

FOREIGN PATENT DOCUMENTS

CN 101293703 A 10/2008
JP 2001214627 A * 8/2001
(Continued)

*Primary Examiner* — Phi D A
(74) *Attorney, Agent, or Firm* — Bridgeway IP Law Group, PLLC; Sang Ho Lee; Hyun Woo Shin

(57) ABSTRACT

A composite material reinforcement device may include: a central portion including an edge portion provided to have an inner space having a trapezoidal cross-section with reference to a longitudinal direction, and a partition wall portion dividing the inner space into at least one partition space; and a reinforcement portion located on a top and a bottom of the central portion and integrally molded to cover the central portion, wherein the reinforcement portion includes: a first plate located on the top of the central portion to cover an upper portion of the central portion; a second plate curved to correspond to a shape of the central portion and located at the bottom of the central portion to cover a lower portion of the central portion; and an extension portion in which the first plate and the second plate extend
(Continued)

from both ends of the central portion to be bonded to each other.

8 Claims, 22 Drawing Sheets

(51) Int. Cl.
*E02D 29/00* (2006.01)
*E04B 1/343* (2006.01)

(58) Field of Classification Search
CPC ..... E04B 1/34384; E04B 5/48; E04B 5/043; E04B 5/21; E04B 5/18; E04B 1/585; E04F 13/0875; E04F 15/107; E04F 13/077
See application file for complete search history.

(56) References Cited

U.S. PATENT DOCUMENTS 2,778,458 A * 1/1957 Briggs ..... E04C 2/3405 105/410
3,732,138 A * 5/1973 Almog ..... E04C 2/205 428/416
3,757,559 A * 9/1973 Welsh ..... B21D 5/01 156/198
3,890,108 A * 6/1975 Welsh ..... B21D 7/06 428/116
4,100,709 A * 7/1978 Good ..... E04B 2/76 52/287.1
4,789,577 A * 12/1988 Leone ..... B29D 24/004 428/36.1
4,916,027 A * 4/1990 DelMundo ..... B64C 1/06 428/668
5,050,362 A * 9/1991 Tal ..... E04D 3/363 52/579
5,115,963 A * 5/1992 Yasui ..... B21D 26/055 228/157
5,141,146 A * 8/1992 Yasui ..... F28F 3/14 29/6.1
5,330,092 A * 7/1994 Gregg ..... B64C 1/08 72/709
5,372,868 A * 12/1994 Prewo ..... E04C 2/34 428/401
5,723,225 A * 3/1998 Yasui ..... B32B 15/01 228/157
6,018,927 A * 2/2000 Major ..... B32B 3/28 248/346.02
6,224,142 B1 * 5/2001 McCormack ..... B60P 3/04 52/586.1
7,051,489 B1 * 5/2006 Swiszcz ..... E04B 9/24 428/116
7,115,317 B2 * 10/2006 Zhuo ..... B32B 5/26 428/116
7,998,299 B2 * 8/2011 McCarville ..... B32B 27/06 156/189
8,646,239 B2 * 2/2014 Rulon ..... E04B 2/50 52/309.7
8,815,038 B2 * 8/2014 McCarville ..... B29C 70/086 156/286
10,309,305 B2 * 6/2019 Biset ..... F02C 7/045
10,676,883 B2 * 6/2020 Lewit ..... E04C 2/3405
12,546,110 B1 * 2/2026 Ahmed ..... B33Y 10/00

FOREIGN PATENT DOCUMENTS

JP 2014-077338 A 5/2014
JP 2014-088690 A 5/2014
JP 2017-089179 A 5/2017
JP 2020196993 A * 12/2020
KR 10-0768257 B1 10/2007
KR 10-0849505 B1 7/2008
KR 10-1008199 B1 1/2011
KR 10-1165320 B1 7/2012
KR 10-1620508 B1 5/2016
KR 10-1879191 B1 8/2018
KR 10-2382819 B1 4/2022

* cited by examiner

COMPOSITE MATERIAL REINFORCEMENT DEVICE FOR BOX-TYPE CONCRETE STRUCTURE AND METHOD OF CONSTRUCTING THE SAME

TECHNICAL FIELD

The present invention relates to a composite material reinforcement device for a box-type concrete structure and a method of constructing the same, and more specifically, to a composite material reinforcement device for a concrete structure and a method of constructing the same, which are effective in improving internal strength and reinforcing earthquake resistance as a cross-section of the concrete structure is expanded and rigidity and ductility capabilities are simultaneously improved using a reinforcement device for a structure in which a composite material and a hollow aluminum beam are integrated with each other.

BACKGROUND ART

In general, box-type concrete structures used for purposes such as underpasses, subways, waterways, etc., may be subject to a load greater than a design load due to filling performed on or a traffic load applied to upper portions of the box-type concrete structures. Such a load causes excessive shear force and negative moment to be applied to a side wall in a vertical direction or a corner, i.e., an edge portion between a ceiling and a side wall, and thus, structural safety is damaged. Accordingly, there are cases when a corner in a box-type concrete structure needs to be structurally reinforced.

Since concrete fails to increase a load-carrying capacity of a member in a negative moment section of the box-type concrete structure, there is a problem in that shear force or negative moment cannot be sufficiently resisted. Therefore, part of the shear force or negative moment applied to the corner in the box-type concrete structure needs to be dispersed by having a reinforcement device sustain the part of the shear force or negative moment applied to the corner.

When there is a need to reinforce this box-type concrete structure, since a reinforcing material needs to be a non-conductor, there is a disadvantage such that a reinforcing material made of a steel plate cannot be used.

In relation to this, a technology of reinforcing strength of a structure by attaching an earthquake-resistant device configured to connect a ceiling to a side wall of a box-type concrete structure has been proposed. However, this earthquake-resistant device only reduces member force by dispersing external force applied to a corner, and does not have an effect of increasing resistance force of a member. Thus, there is such a problem that performance of earthquake resistance against a seismic load is insufficient.

As a prior art document, Korean Patent Publication No. 10-1879191, entitled "Seismic Reinforcement Device for Corner of Box-type Underground Structure and Method of Constructing the Same," is disclosed.

DISCLOSURE OF INVENTION

Technical Problem

Therefore, the present invention has been made in view of the above problems, and it is an object of the present invention to provide a composite material reinforcement device for a box-type concrete structure and a method of constructing the same, which are effective in improving internal strength and reinforcing earthquake resistance, by applying the composite material reinforcement device having a composite material and a hollow aluminum beam integrated with each other to a concrete structure to expand a cross-section of a concrete structure and simultaneously improve rigidity and ductility capabilities.

Technical Solution

To accomplish the above object, according to one aspect of the present invention, there is provided a composite material reinforcement device for a concrete structure, the composite material reinforcement device having a length in a forward-and-rear direction to reinforce earthquake resistance of a box-type concrete structure and including: a central portion including an edge portion provided to have an inner space having a trapezoidal cross-section with reference to a longitudinal direction, and a partition wall portion dividing the inner space into at least one partition space; and a reinforcement portion located on a top and a bottom of the central portion and integrally molded to cover the central portion, wherein the reinforcement portion includes: a first plate located on the top of the central portion to cover an upper portion of the central portion; a second plate curved to correspond to a shape of the central portion and located at the bottom of the central portion to cover a lower portion of the central portion; and an extension portion in which the first plate and the second plate extend from both ends of the central portion to be bonded to each other.

In addition, the composite material reinforcement device may be installed when an upper surface of the first plate is in contact with a part of the box-type concrete structure, the part being vulnerable to vibration.

In addition, the second plate may include a cutting line disposed in a lower surface, and the composite material reinforcement device may be bent with reference to the cutting line to be installed in a portion in which the box-type concrete structure is bent.

In addition, the central portion may be made of an aluminum alloy, and the reinforcement portion may include a prepreg sheet provided by impregnating a thermosetting resin into a fiber sheet including at least one of carbon fiber and glass fiber.

In addition, the central portion may be provided in plurality to be extensible in a width direction.

In addition, the composite material reinforcement device may further include a connection member configured to connect a plurality of composite material reinforcement devices to each other in a longitudinal direction to be longitudinally extensible, wherein the connection member is provided to have a bar shape and coupled between an end of one composite material reinforcement device and an end of another composite material reinforcement device to be inserted into one of the at least one partition space of the central portion of each of the plurality of composite material reinforcement devices.

In addition, the central portion may further include a fixing portion arranged in a lower portion of the at least one partition space and configured to fix the connection member, and the fixing portion may include: a fixing bar disposed along a length in the at least one partition space such that an upper surface of the fixing bar is in contact with the connection member; and a plurality of fixing springs disposed on a lower surface of the at least one partition space such that upper ends of the plurality of fixing springs are connected to a lower surface of the fixing bar.

In addition, the fixing bar may be divided into a plurality of zones on an upper surface along a longitudinal direction to have one fixing protrusion disposed on each of the plurality of zones, and the connection member may have a fixing groove disposed in a position on a lower surface in correspondence with the one fixing protrusion to couple the one fixing protrusion into the fixing groove to thereby increase fixing power of the connection member with respect to the composite material reinforcement device.

In addition, the fixing portion may further include an upward-and-downward movement portion configured to increase fixing power of the connection member by compressing the fixing spring to fix the fixing bar to be located in a lower portion or expanding the fixing spring to fix the fixing bar to be located in an upper portion, and the upward-and-downward movement portion may include: a movement member disposed on a lower surface of the fixing bar to penetrate through a lower surface of the composite material reinforcement device; and a movement hole disposed in a lower surface of the composite material reinforcement device so that the movement member penetrates through the movement hole.

In addition, the fixing bar may define an inner space of the fixing bar by having a hollow portion therein, and the movement member may include: a head portion provided to have a plate shape and located in the inner space of the fixing bar; a body portion provided to have a cylindrical shape on a lower surface of the head portion and located inside the fixing spring such that an upper side penetrates through a lower surface of the fixing bar and a lower side penetrates through the movement hole; a leg portion provided to have a plate form on a lower surface of the body portion and located on a lower surface of the composite material reinforcement device; and a movement protrusion disposed on a side surface of the body portion to penetrate through the movement hole, and then, rotate to be fixed to a lower surface of the composite material reinforcement device.

In addition, according to another aspect of the present invention, there is provided a method of constructing a composite material reinforcement device configured to reinforce earthquake resistance of a box-type concrete structure, the method including: a device preparation step of preparing at least one composite material reinforcement device including a central portion including an edge portion provided to have an inner space having a trapezoidal cross-section with reference to a longitudinal direction and a partition wall portion dividing the inner space into at least one partition space, and a reinforcement portion located on a top and a bottom of the central portion and integrally molded to cover the central portion; a fixing step of fixing the at least one composite material reinforcement device to the box-type concrete structure using an anchor in a state when an upper surface of a first plate is in contact with a part of the box-type concrete structure, the part being vulnerable to vibration; and a filling step of filling the at least one partition space with a reinforcing material.

In addition, the method may further include, after the device preparation step, a bending forming step of bending the at least one composite material reinforcement device with reference to a cutting line to install the at least one composite material reinforcement device in a portion in which the box-type concrete structure is bent.

In addition, the method may further include, after the device preparation step, a connection step of inserting a connection member into the at least one partition space by connecting a plurality of composite material reinforcement devices to each other in a longitudinal direction to be extensible in the longitudinal direction, wherein the connection member is provided to have a bar shape and coupled between an end of one composite material reinforcement device and an end of another composite material reinforcement device to be inserted into one of the at least one partition space of the central portion of each of the plurality of composite material reinforcement devices.

Advantageous Effects

According to an embodiment of the present invention, a composite material reinforcement device for a concrete structure and a method of constructing the same are effective in improving internal strength and reinforcing earthquake resistance with respect to a structure, as a composite material and a hollow aluminum beam are integrated with each other.

In addition, since a chemically resistant material provides excellent corrosion resistance against pollution, sewage, etc., there is such an advantage that physical properties are not worsened even for a long period of time.

In addition, a shear reinforcement effect may be increased by simultaneously reinforcing a slab and a corner.

BEST MODE FOR CARRYING OUT THE INVENTION

Figure 1A:
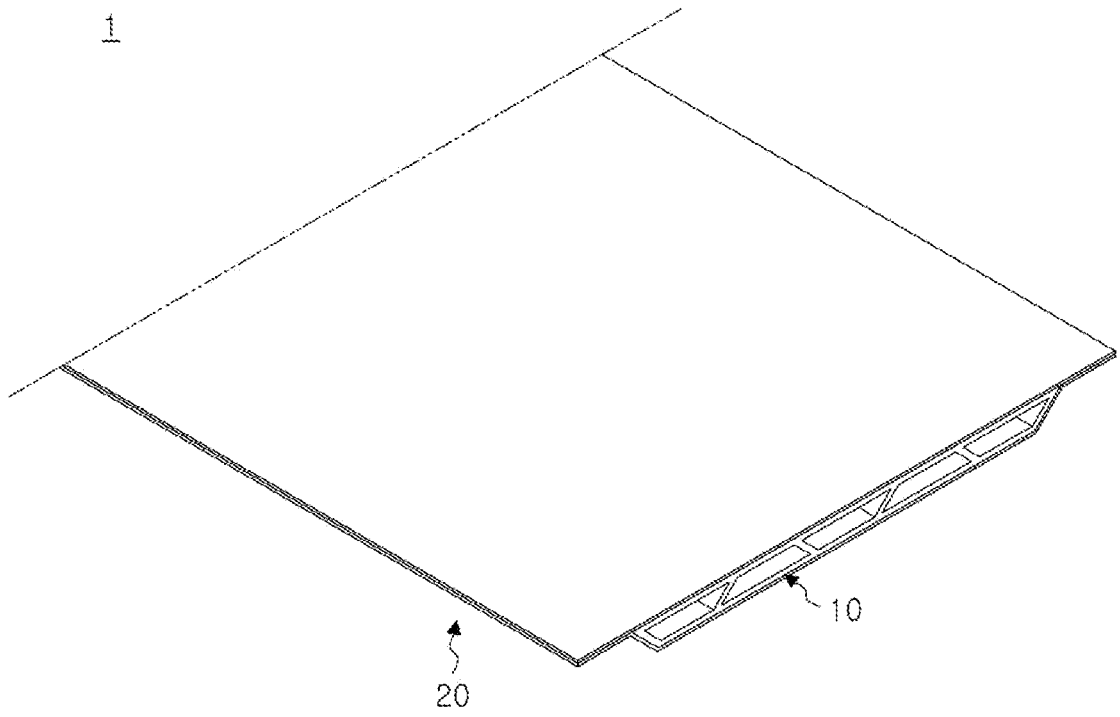
FIGS. 1A and 1B are a perspective view and a lateral cross-sectional view each illustrating a composite material reinforcement device according to an embodiment of the present invention.

Hereinafter, the description of the present invention with reference to the drawings is not limited to particular modes of practice, and allows for various changes and numerous embodiments. In addition, it is to be appreciated that all changes, equivalents, and substitutes that do not depart from the spirit and technical scope of the present invention are encompassed in the present invention.

Although the terms such as first, second, etc. may be used herein to describe various components, these components should not be limited by these terms. These terms are only used to distinguish one component from another component.

Like reference numerals in the drawings throughout the specification denote like elements.

An expression used in the singular encompasses the expression of the plural, unless it has a clearly different meaning in the context. In addition, it is to be understood that the terms such as "including," "comprising," or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

Unless otherwise defined, all terms including technical and scientific terms used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, when describing with reference to the accompanying drawings, like reference numerals in the drawings denote like elements, and thus their descriptions will not be repeated. In the description of the present invention, certain detailed explanations of related art are omitted when it is deemed that they may unnecessarily obscure the essence of the present invention.

Hereinafter, an embodiment of the present invention will be described in detail with reference to the accompanying drawing including FIGS. 1A to 17.

Figure 1B:
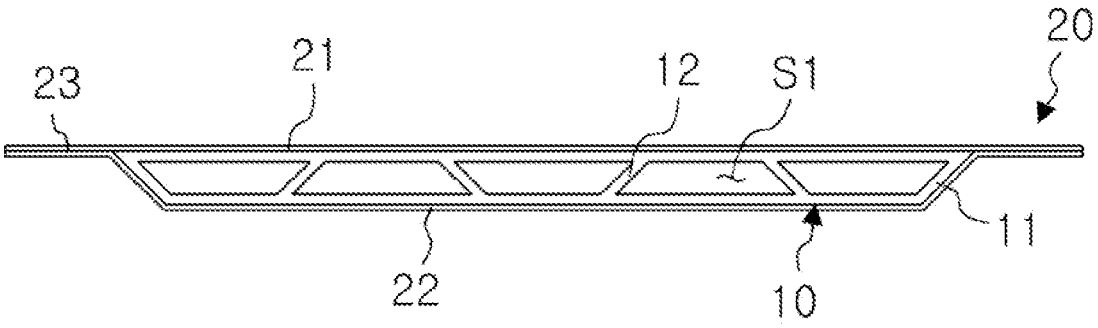
Figure 2A:
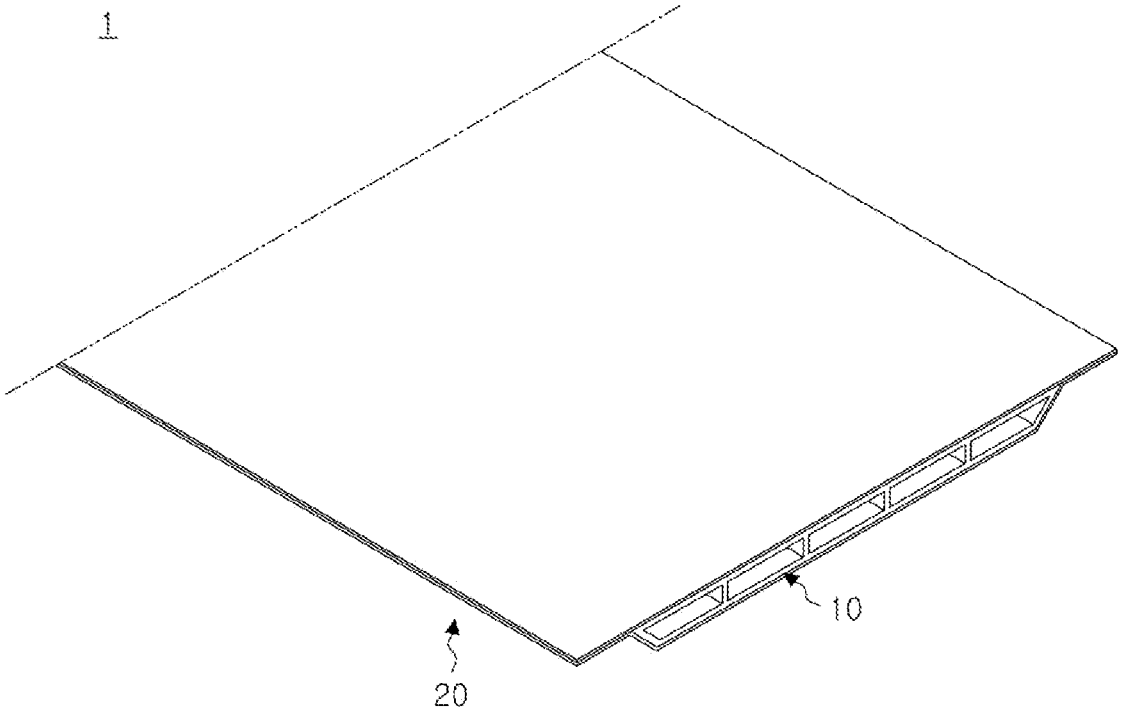
FIGS. 2A and 2B are a perspective view and a lateral cross-sectional view each illustrating longitudinal disposition of a partition wall of a central portion of FIGS. 1A and 1B.
Figure 2B:
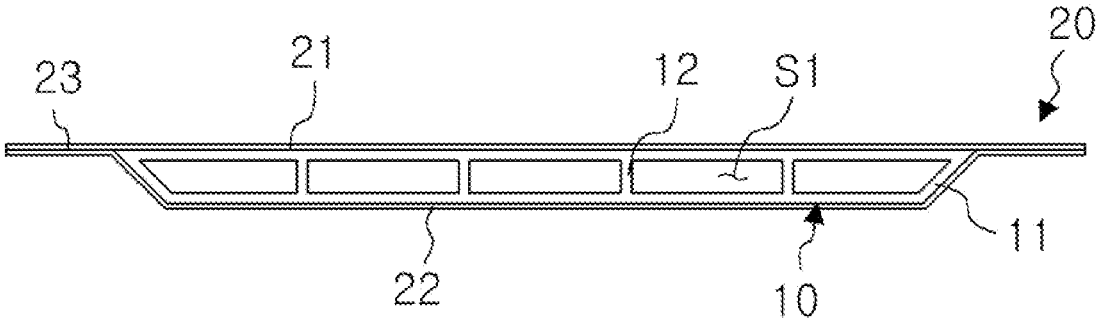
Figure 3A:
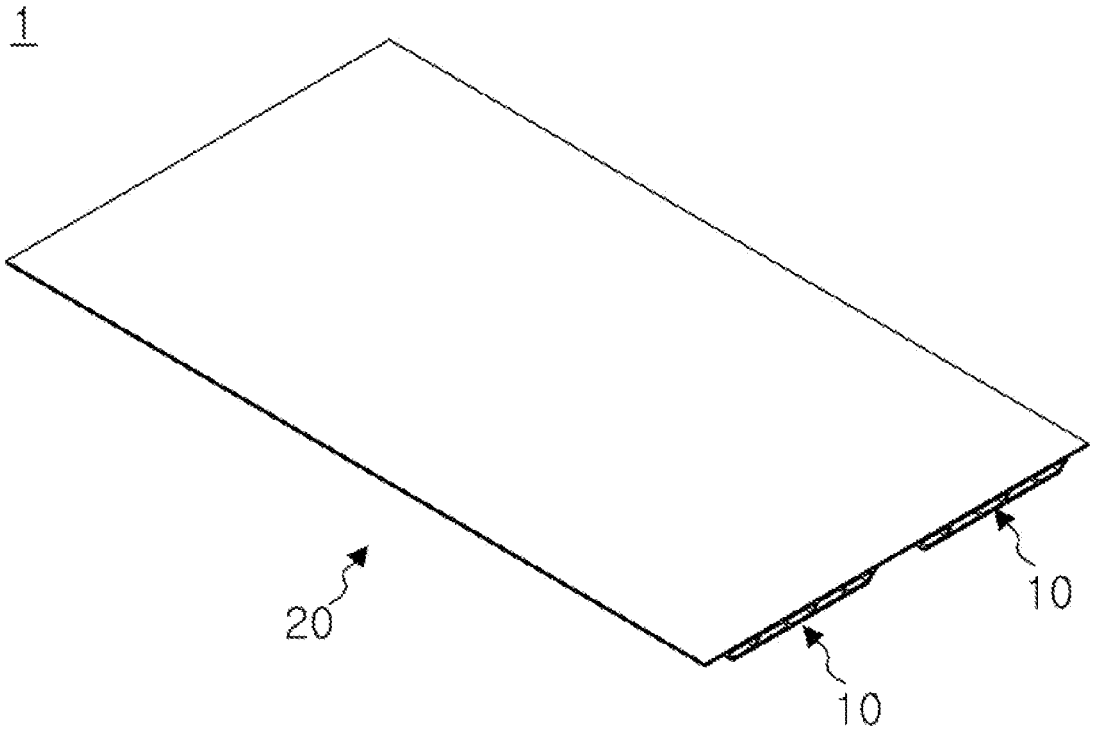
FIGS. 3A and 3B are a perspective view and a lateral cross-sectional view each illustrating disposition of two central portions of FIGS. 1A and 1B.
Figure 3B:
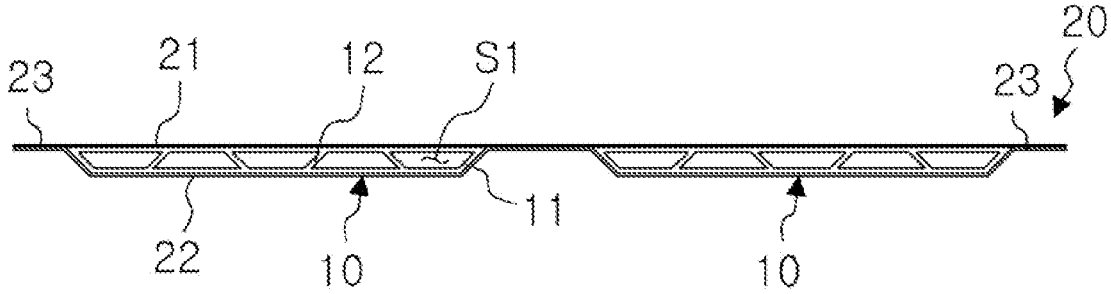

FIGS. 1A and 1B are a perspective view and a lateral cross-sectional view each illustrating a composite material reinforcement device according to an embodiment of the present invention. FIGS. 2A and 2B are a perspective view and a lateral cross-sectional view each illustrating longitudinal disposition of a partition wall of a central portion of FIGS. 1A and 1B. FIGS. 3A and 3B are a perspective view and a lateral cross-sectional view each illustrating disposition of two central portions of FIGS. 1A and 1B.

A box-type concrete structure 2 is a closed polygonal structure installed in an underpass, a subway, a waterway, etc. and including an upper slab, side walls on both sides, and a lower floor.

Referring to FIGS. 1A to 3B, a composite material reinforcement device 1 according to an embodiment of the present invention may be installed in a part of the box-type concrete structure 2, the part being vulnerable to vibration. In detail, the composite material reinforcement device 1 may be installed in various locations that are vulnerable to vibration and need seismic reinforcement or strength reinforcement, such as pillars and corners of the box-type concrete structure 2, but a location of the composite material reinforcement device 1 is not limited thereto. Accordingly, the composite material reinforcement device 1 may increase an effect of seismic reinforcement, shear reinforcement, etc. on an installation area, and include a central portion 10 and a reinforcement portion 20.

The central portion 10 is made of an aluminum alloy and is located at a center of the composite material reinforcement device 1 to provide support inside, and may include an edge portion 11 and a partition wall portion 12.

The edge portion 11 may be provided to have an inner space having a trapezoidal cross-section with reference to a longitudinal direction. The edge portion 11 may be, most preferably, provided to have a trapezoidal shape, but is not limited thereto. The edge portion 11 may be provided to have various types of shape such as a square or a triangle.

The partition wall portion 12 may divide the inner space into one or more partition spaces S1. Each of the partition spaces S1, obtained by dividing the partition wall portion 12, may be provided to have a certain shape.

In detail, as illustrated in FIGS. 1A and 1B, the partition wall portion 12 may be diagonally arranged in the inner space, and neighboring partition wall portions 12 may be arranged in opposite directions so that cross-sections of the partition spaces S1 have a trapezoidal shape.

In addition, the partition wall portion 12 may be disposed vertically as illustrated in FIGS. 2A and 2B so that cross-sections of the central partition spaces S1 located at a center may have a quadrilateral shape. As such, the partition wall portion 12 may be disposed such that the partition spaces S1 are provided to have various shapes according to positions of and angles between partition wall portions 12, but is not limited thereto.

A plurality of central portions 10 may be provided to be extensible in a width direction. In detail, as illustrated in FIGS. 3A and 3B, two central portions 10 may be provided to extend in a width direction, thereby enabling seismic reinforcement and shear reinforcement over a large area using one composite material reinforcement device 1.

Accordingly, one or more central portions 10 may be provided in correspondence with a width of a construction surface, and one composite material reinforcement device 1 may be installed on the construction surface. This may be effective in seismic reinforcement and shear reinforcement and reduce construction time.

The reinforcement portion 20 is located on a top and a bottom of the central portion 10 and integrally molded to cover the central portion 10, and may include a first plate 21, a second plate 22, and an extension portion 23.

The first plate 21 may be located on the top of the central portion 10 to cover an upper portion of the central portion 10, and may be disposed to have a flat surface.

The second plate 22 may be curved to correspond to a shape of the central portion 10 and located at the bottom of the central portion 10 to cover a lower portion of the central portion 10.

The extension portion 23 may be formed such that the first plate 21 and the second plate 22 extend from both ends of the central portion 10 and are bonded to each other.

The reinforcement portion 20 may include, most preferably, a prepreg sheet provided by impregnating a thermosetting resin into a fiber sheet containing at least one of carbon fiber and glass fiber. In this case, various types of thermosetting resin such as a phenol resin, an epoxy resin, a polyester resin, etc. may be used. Most preferably, a phenol resin may be used, but the present invention is not limited thereto.

Additionally, in the reinforcement portion 20, inexpensive glass fiber is applied to the first plate 21 and carbon fiber having high strength is applied to the second plate 22 to provide support from a bottom. Thus, the composite material reinforcement device 1 such that strength is increased and a cost is reduced may be provided.

In the reinforcement portion 20 configured in this way, the first plate 21 and the second plate 22 may be integrally provided to be in contact with each other in the extension portion 23 to have the central portion 10 at a center therebetween. Thus, strength of the central portion 10 may be reinforced, and the composite material reinforcement device 1 may have a light weight.

In this case, when being installed in the box-type concrete structure 2, the composite material reinforcement device 1 may be fixedly installed in the box-type concrete structure 2 by having an upper surface of the first plate 21 in contact with a part of the box-type concrete structure 2 vulnerable to vibration, i.e., a construction surface.

Accordingly, the composite material reinforcement device 1 may be installed to be stably fixed to the construction surface by bringing an upper surface of the first plate (21) which is flat overall into contact with the construction surface and having an anchor inserted into the extension portion 23.

Figure 4A:
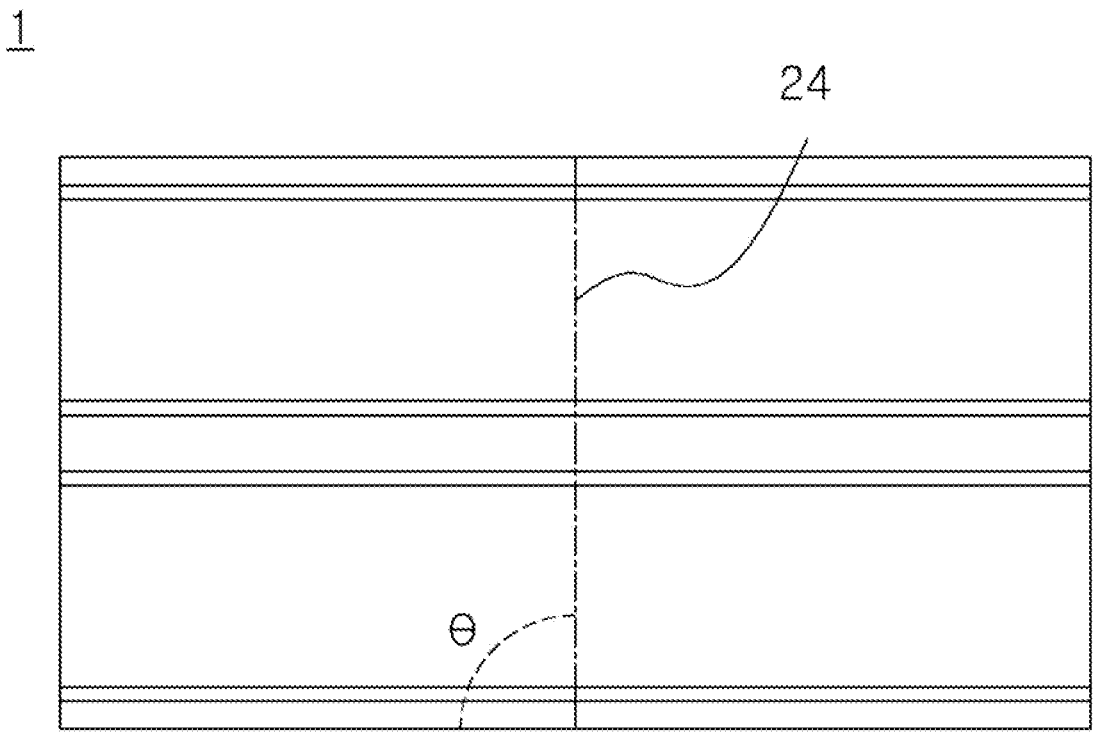
FIGS. 4A and 4B are bottom plan views illustrating disposition of a cutting line in the composite material reinforcement device of FIGS. 1A and 1B at an angle of 90° and 70°, respectively, in a longitudinal direction.
Figure 4B:
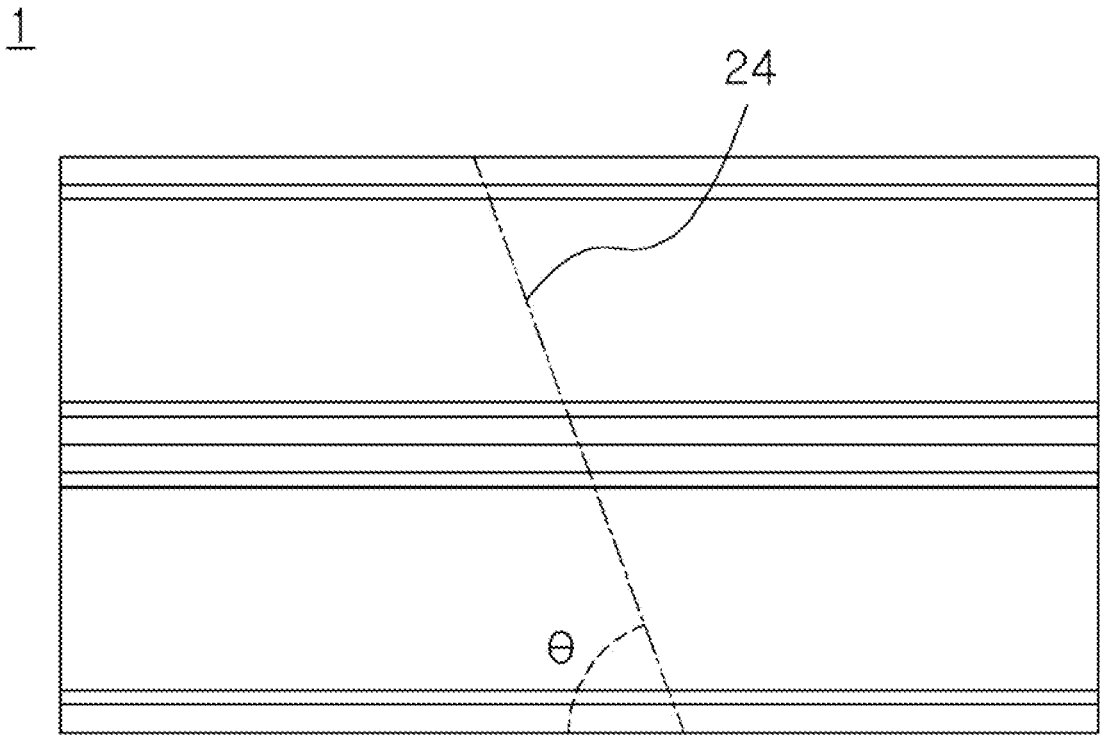
Figure 5:
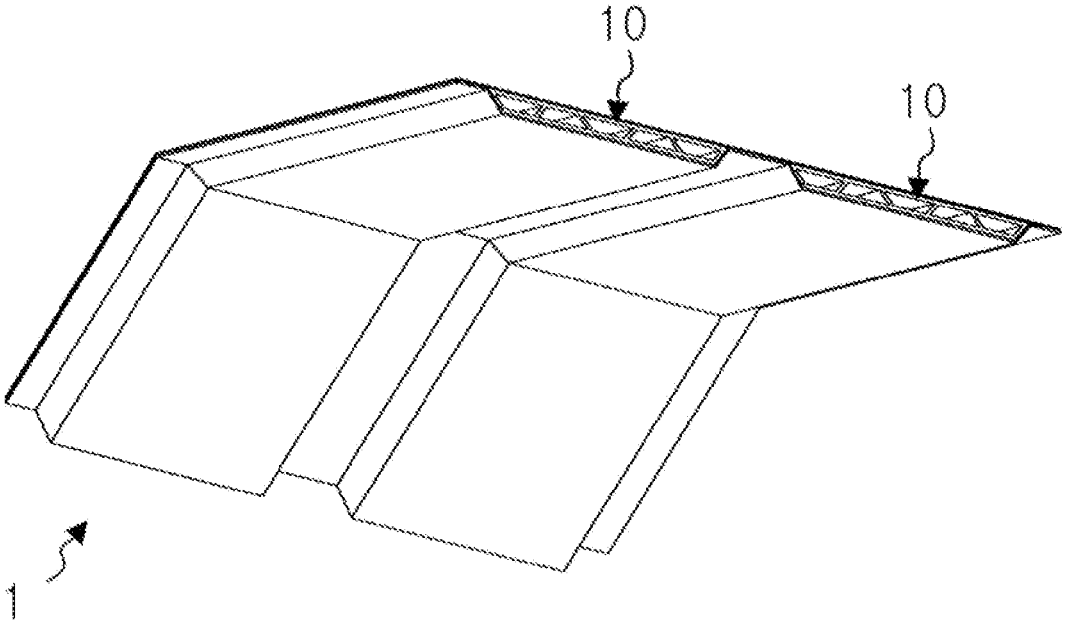
FIG. 5 is a perspective view illustrating the composite material reinforcement device bent along the cutting line of FIG. 4A.
Figure 6:
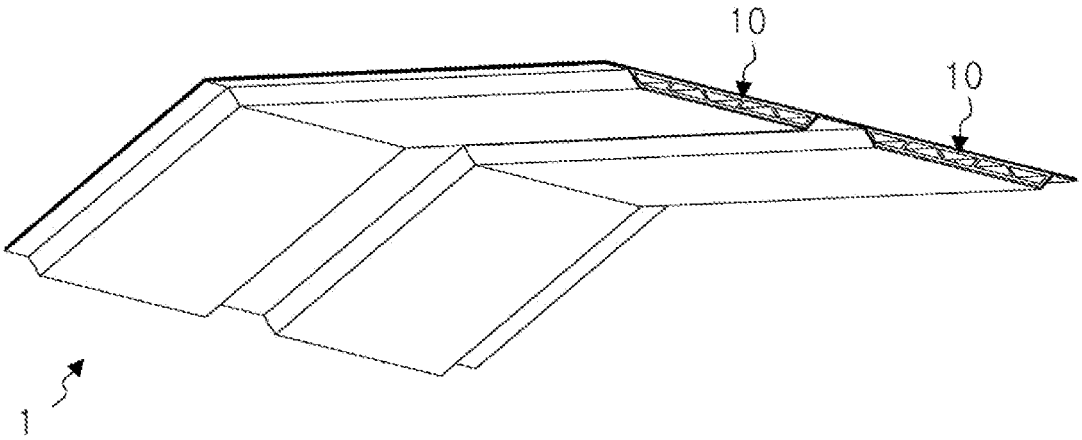
FIG. 6 is a perspective view illustrating the composite material reinforcement device bent along the cutting line of FIG. 4B.
Figure 7A:
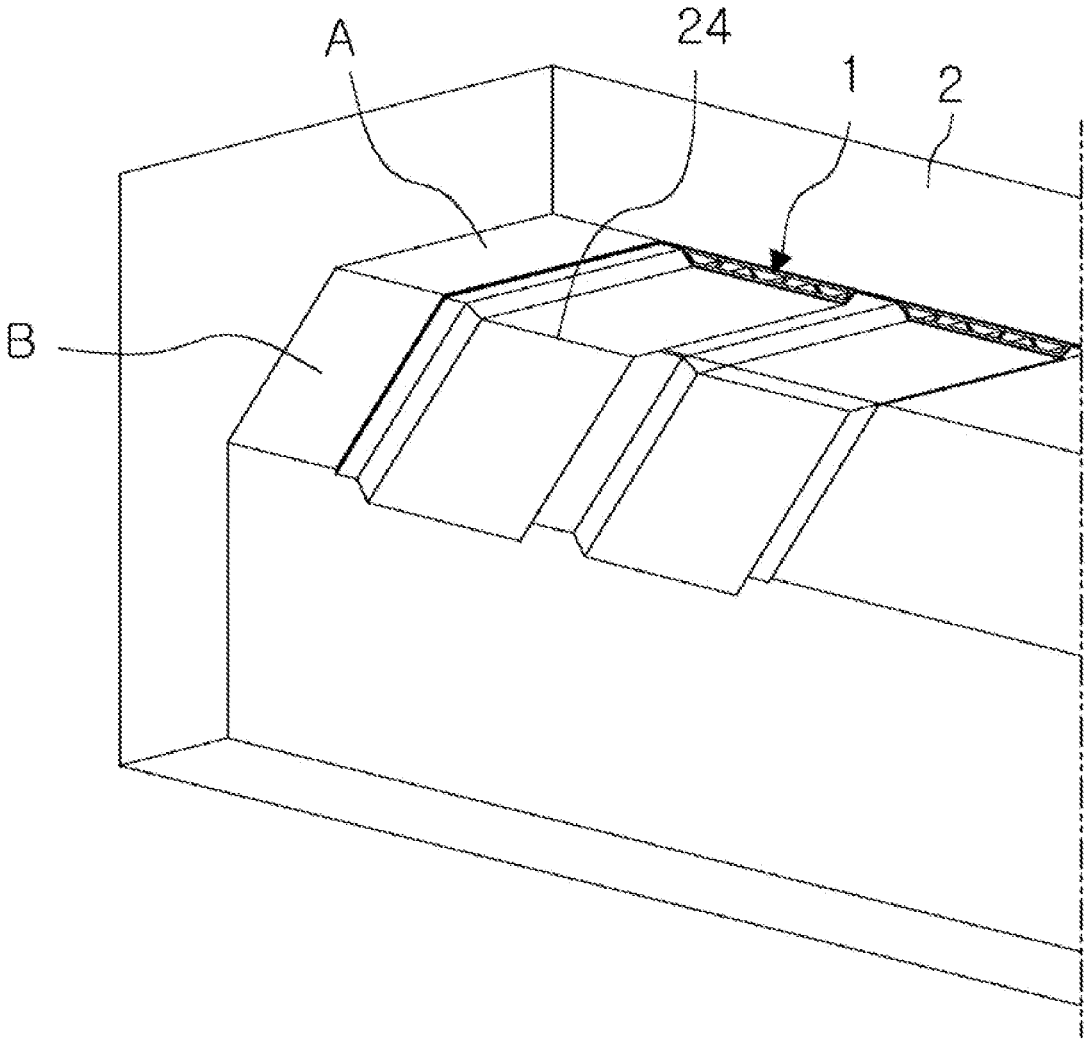
FIGS. 7A and 7B illustrate an example in which the composite material reinforcement device of FIG. 5 is installed at a corner of a box-type concrete structure.
Figure 7B:
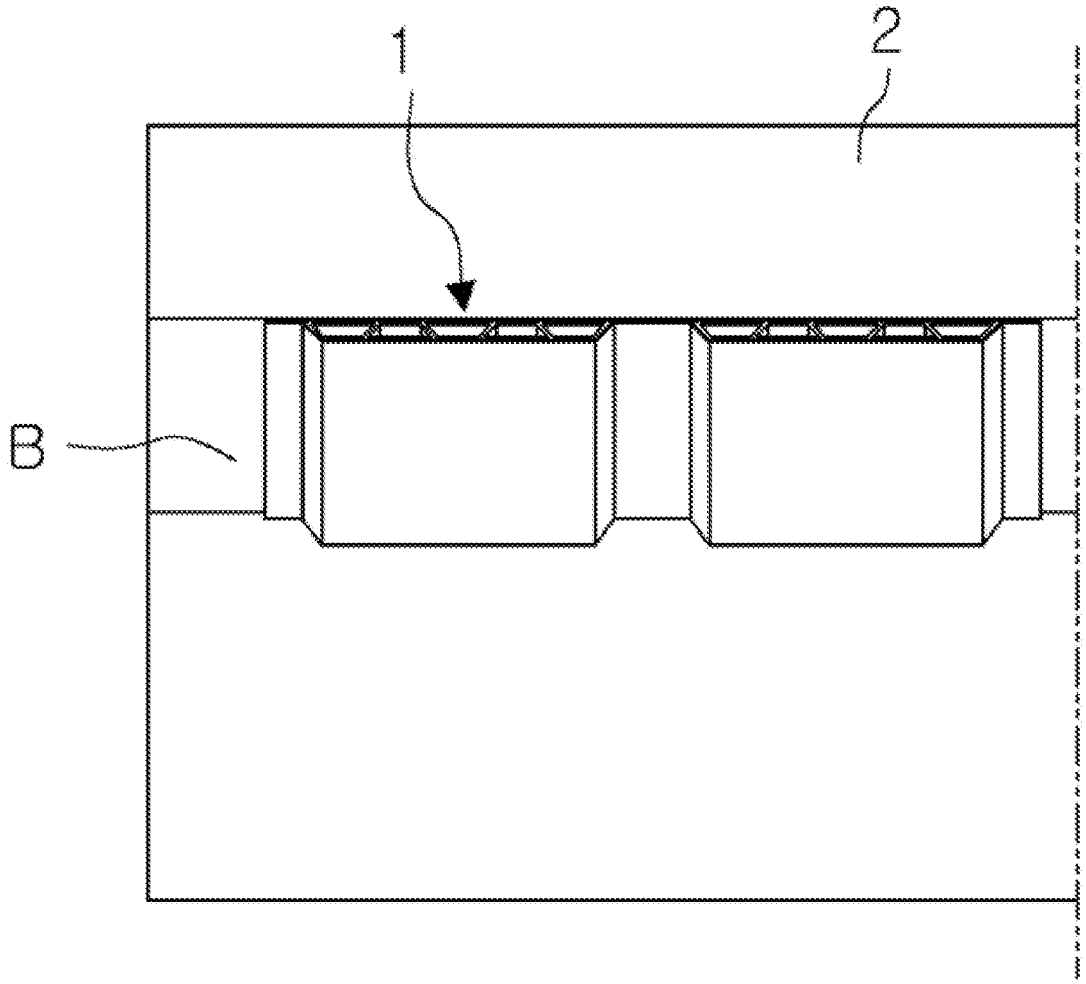
Figure 8A:
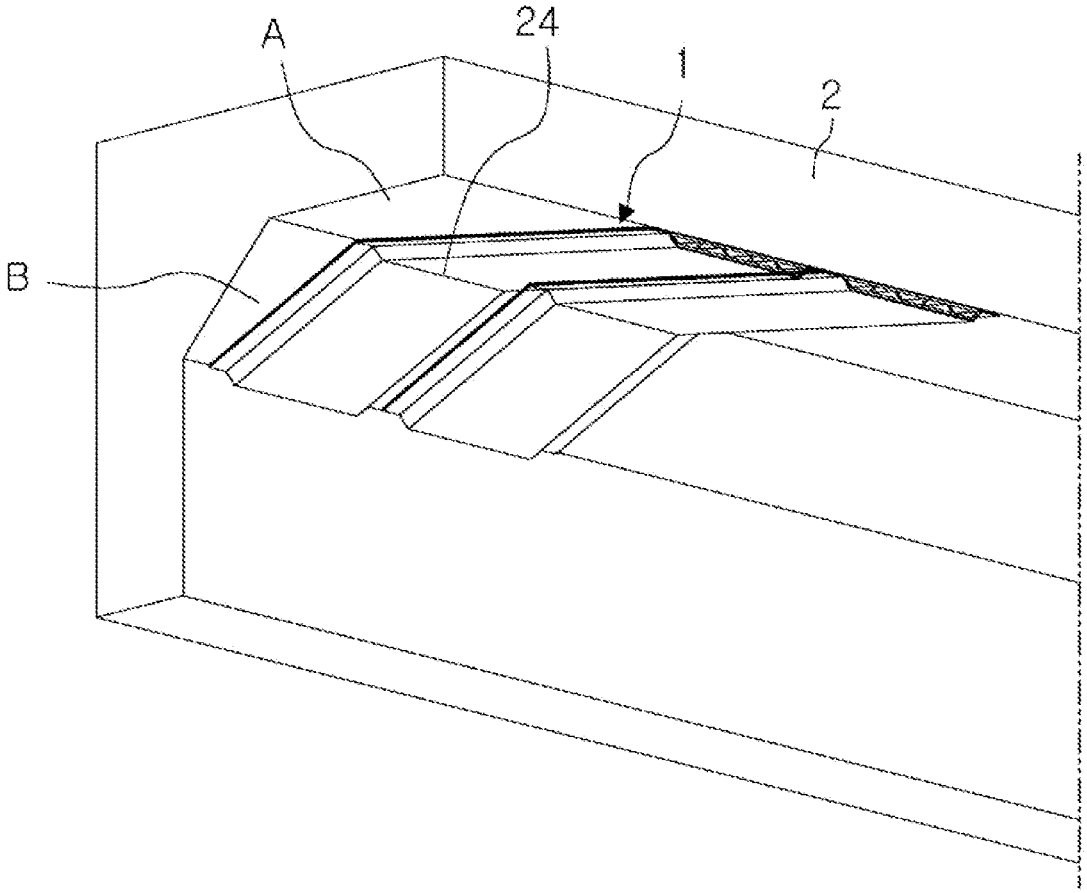
FIGS. 8A and 8B illustrate an example in which the composite material reinforcement device of FIG. 6 is installed at a corner of the box-type concrete structure.
Figure 8B:
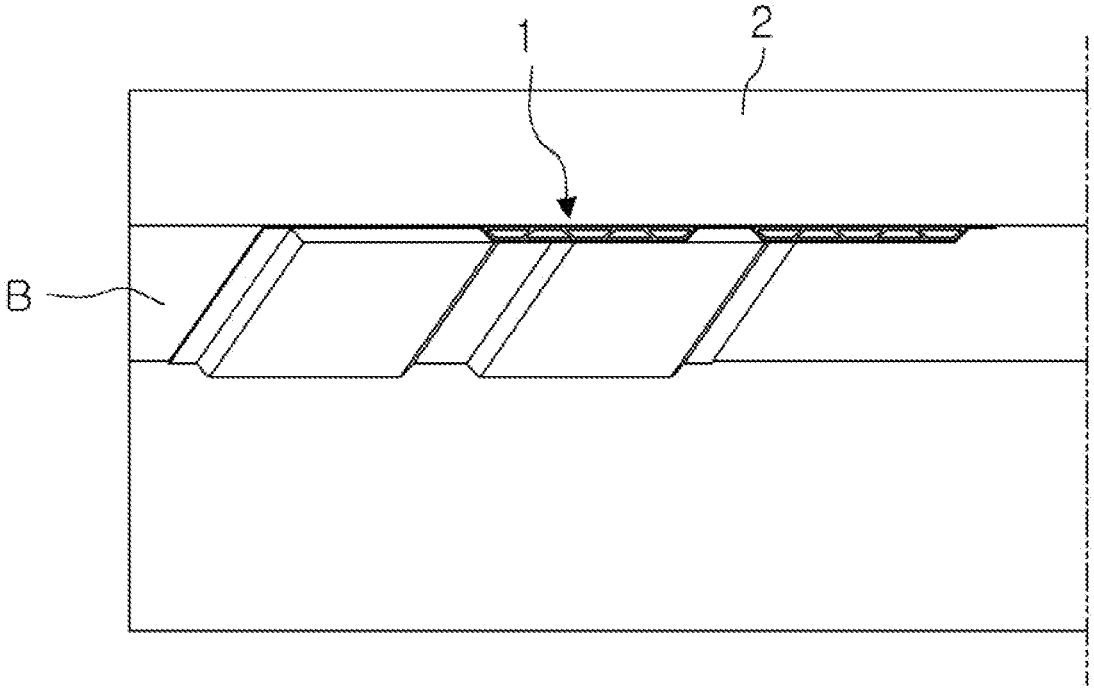
Figure 9A:
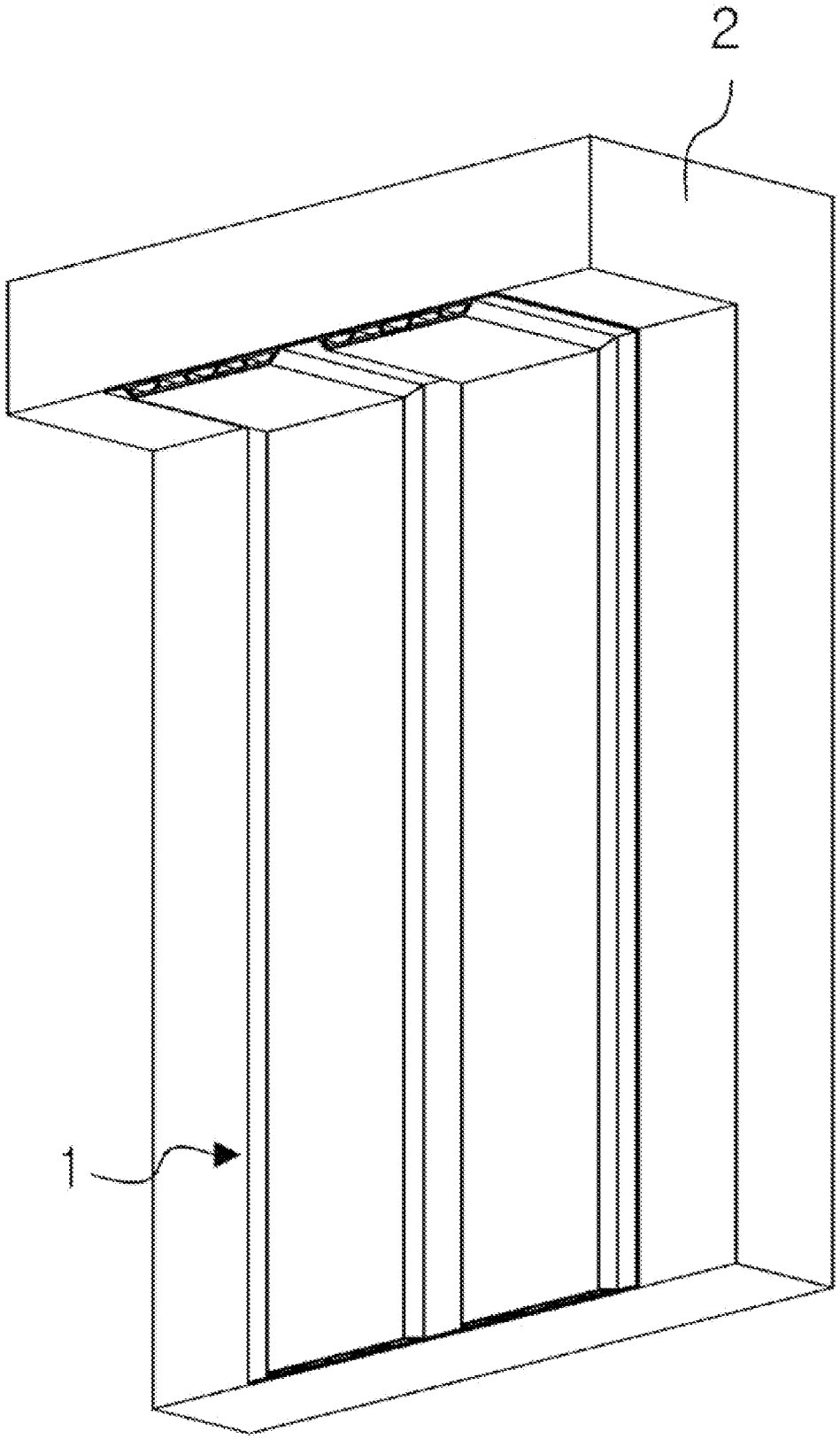
FIGS. 9A and 9B illustrate examples in which the composite material reinforcement device according to an embodiment of the present invention is installed at a column of the box-type concrete structure.
Figure 9B:
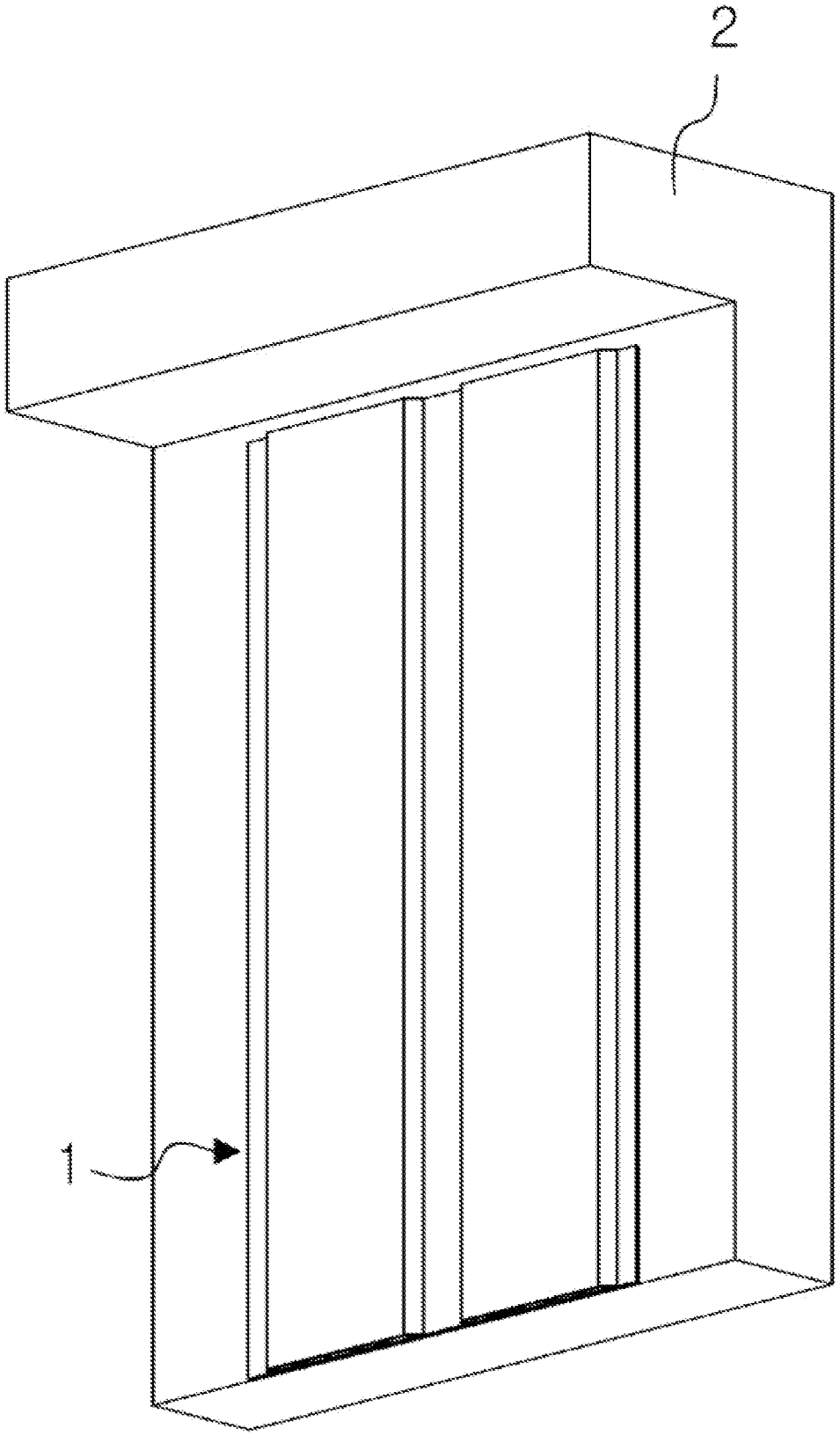

FIGS. 4A and 4B are bottom plan views illustrating disposition of a cutting line in the composite material reinforcement device of FIGS. 1A and 1B at an angle of 90° and 70°, respectively, in a longitudinal direction. FIG. 5 is a perspective view illustrating the composite material reinforcement device bent along the cutting line of FIG. 4A. FIG. 6 is a perspective view illustrating the composite material reinforcement device bent along the cutting line of FIG. 4B. FIGS. 7A and 7B illustrate an example in which the composite material reinforcement device of FIG. 5 is installed at a corner of the box-type concrete structure. FIGS. 8A and 8B illustrate an example in which the composite material reinforcement device of FIG. 6 is installed at a corner of the box-type concrete structure. FIGS. 9A and 9B illustrate examples in which the composite material reinforcement device according to an embodiment of the present invention is installed at a column of the box-type concrete structure.

Referring to FIGS. 4A to 9B, the second plate 22 of the composite material reinforcement device 1 according to an embodiment of the present invention may include a cutting line 24 disposed in a lower surface. The cutting line 24 is a reference line for which the composite material reinforcement device 1 is bent. As the composite material reinforcement device 1 is bent with reference to the cutting line 24, the composite material reinforcement device 1 may be installed on a part of the box-type concrete structure 2 in which a construction surface is bent.

In detail, as illustrated in FIGS. 5 and 6, the composite material reinforcement device 1 may be bent inward with reference to the cutting line 24 to reinforce a part of the box-type concrete structure 2 in which a construction surface is bent to thereby increase an effect of shear reinforcement.

Particularly, the composite material reinforcement device 1 may be easily applied to a bent part such as a beam-column joint, a wall-floor plate joint, etc. which is vulnerable to an earthquake. For example, the composite material reinforcement device 1 may be positioned sequentially from a slab A to a corner B, which are most vulnerable to an earthquake in the box-type concrete structures 2, to reinforce a sectional force of the corner B, thereby improving internal strength and reinforcing earthquake resistance.

In this case, the cutting line 24 may be disposed at an angle of 45 to 90° with reference to a longitudinal direction. The cutting line 24 may be preferably disposed at an angle of 68 to 75°, and most preferably at an angle of 70°, but is not limited thereto.

In detail, comparing FIGS. 7A and 7B to FIGS. 8A and 8B, it may be understood that the composite material reinforcement device 1 having the cutting line disposed at an angle of 70° as shown in FIG. 6 has a larger surface in contact with the slab A and the corner B, compared to a surface of the composite material reinforcement device 1 having the cutting line 24 disposed at an angle of 90° as shown in FIG. 5. Accordingly, the composite material reinforcement device 1 with the cutting line 24 disposed at an angle of 70° has such an advantage that an area to be reinforced may be enlarged by bringing a large area into contact with the slab A and the corner B to thereby improve reinforcement performance.

The composite material reinforcement device 1 may reinforce not only the slab A and the corner B, but also a column of the box-type concrete structure 2 as shown in FIGS. 9A and 9B. In addition, as the composite material reinforcement device 1 is bent along the cutting line 24, reinforcement may be extended from the column to an upper slab as shown in FIG. 9A.

Figure 10A:
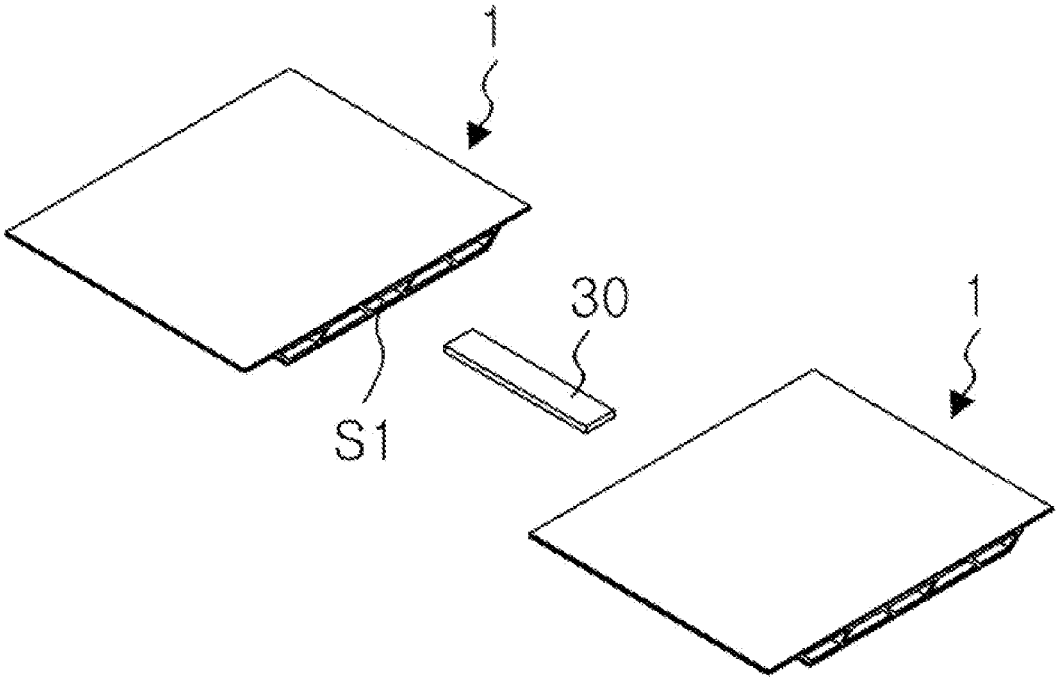
FIGS. 10A to 10C illustrate an example in which the composite material reinforcement device according to an embodiment of the present invention is longitudinally extended through a connection member.
Figure 10B:
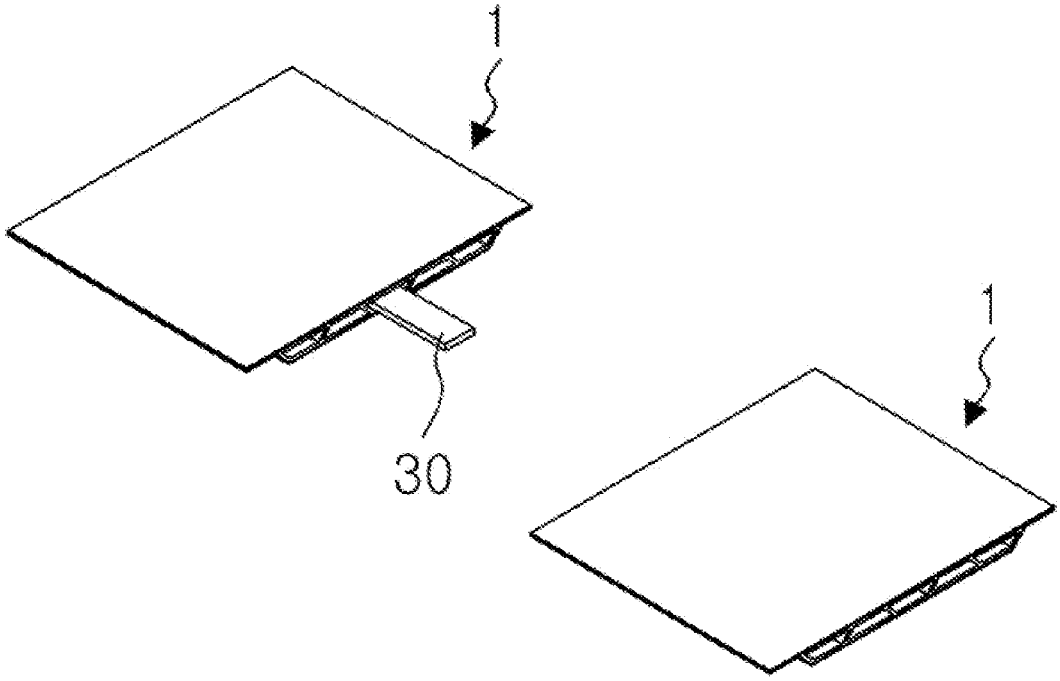
Figure 10C:
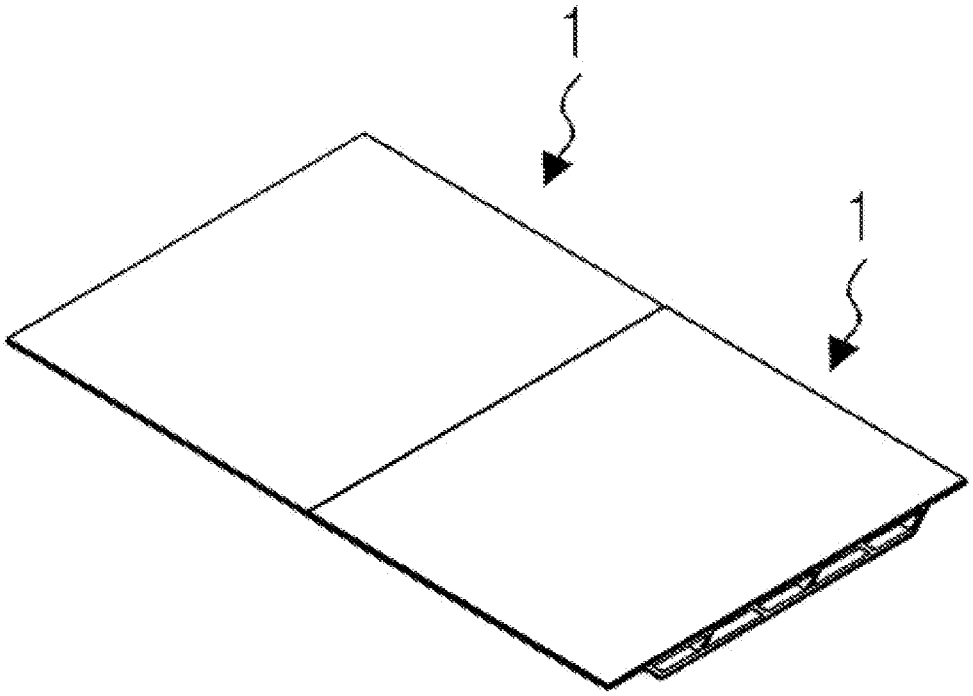

FIGS. 10A to 10C illustrate an example in which the composite material reinforcement device according to an embodiment of the present invention is longitudinally extended through a connection member.

Referring to FIGS. 10A to 10C, the composite material reinforcement device 1 according to an embodiment of the present invention may further include a connection member 30 configured to connect a plurality of composite material reinforcement devices 1 to each other in a longitudinal direction to be longitudinally extended.

The connection member 30 may be preferably provided to have a bar shape with such a size that the connection member 30 may be inserted into one of the partition spaces S1.

The connection member 30 may be coupled between an end of one composite material reinforcement device 1 and an end of another composite material reinforcement device 1. In detail, the connection member 30 may have one end inserted into a partition space S1 of one composite material reinforcement device 1 as shown in FIG. 10B, and another end inserted into a partition space S1 of another composite material reinforcement device 1 as shown in FIG. 10C to connect a pair of composite material reinforcement devices 1 to each other in a longitudinal direction as shown in FIG. 10C. In this case, the connection member 30 may be preferably inserted into partition spaces S1 located on a same line among the plurality of partition spaces S1 so that the pair of composite material reinforcement devices 1 may be evenly connected to each other.

As such, the plurality of composite material reinforcement devices 1 may be connected to each other through the connection member 30 to be applied to various construction portions such as a long or large area, etc. as needed by a constructor.

Figure 11A:
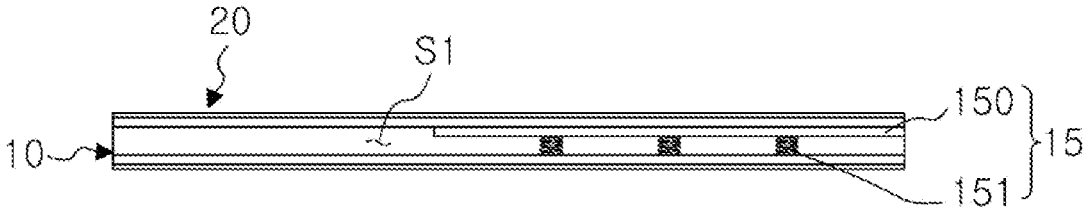
FIGS. 11A and 11B illustrate an example of inserting the connection member in a state when a fixing portion is disposed on the central portion of the composite material reinforcement device according to an embodiment of the present invention.
Figure 11B:
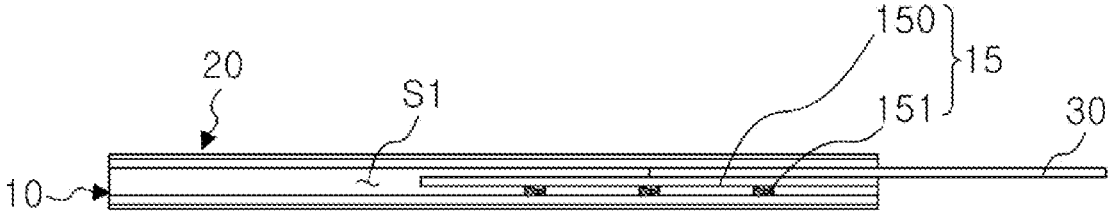
Figure 12A:
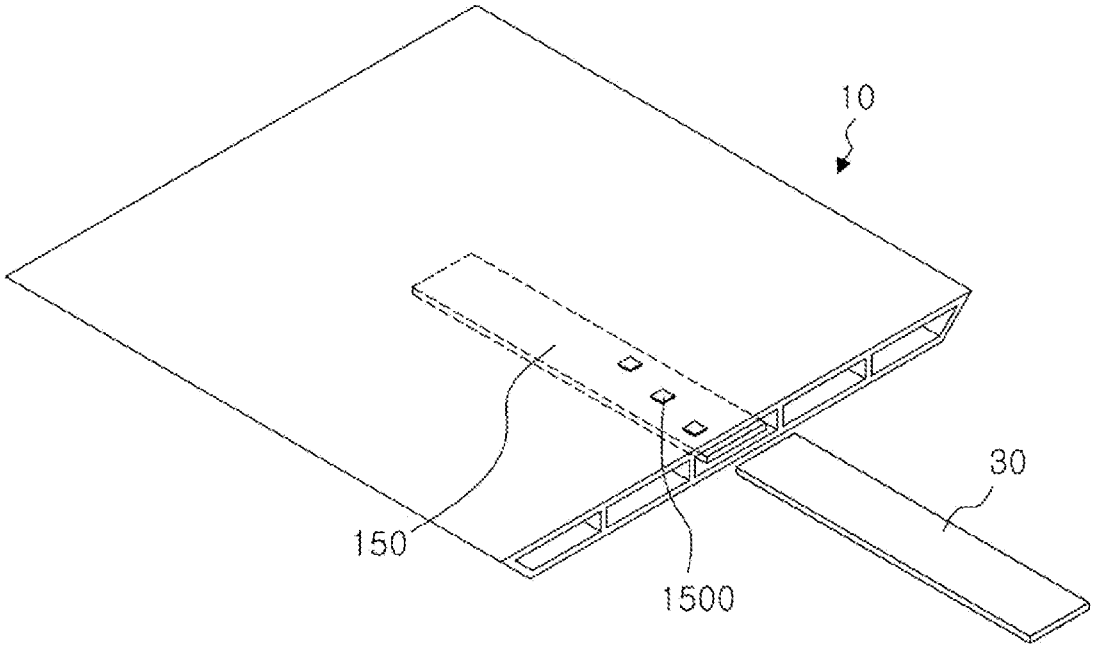
FIGS. 12A and 12B are a projection perspective view and a bottom projection perspective view illustrating a protrusion disposed on a fixing bar of FIG. 11A and a fixing groove disposed in a connection member of FIG. 11B, respectively.
Figure 12B:
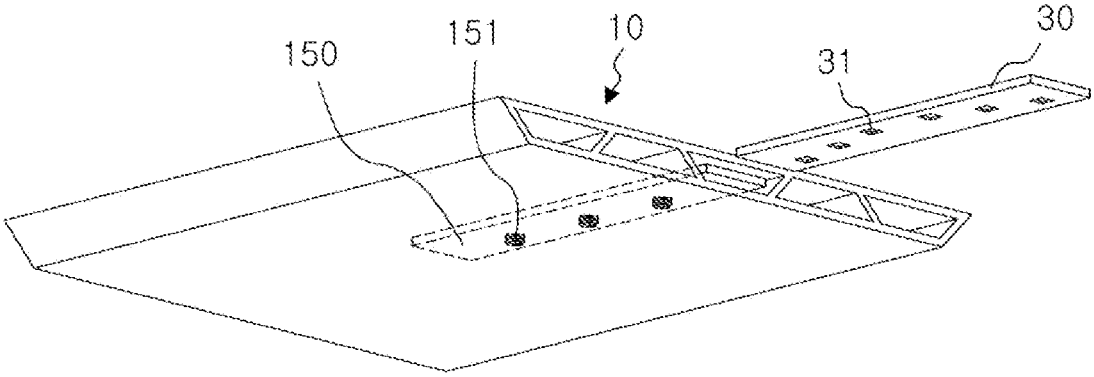
Figure 13A:
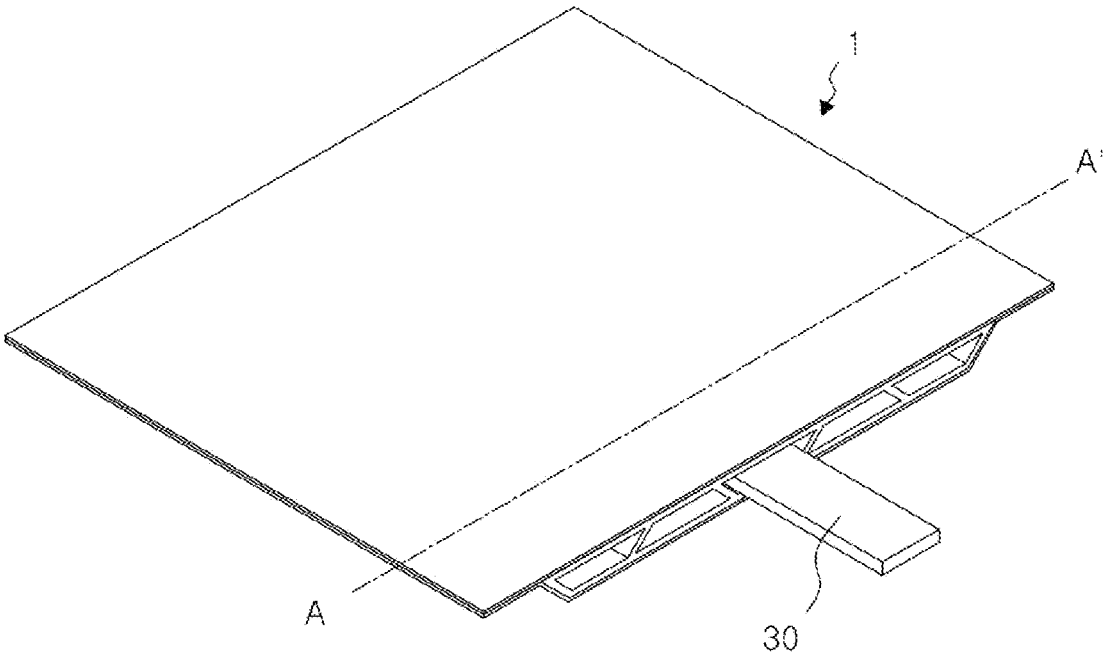
FIGS. 13A and 13B are a perspective view illustrating the connection portion inserted into the composite material reinforcement device of FIGS. 12A and 12B and a cross-sectional view of the composite material reinforcement device taken along line A-A'.
Figure 13B:
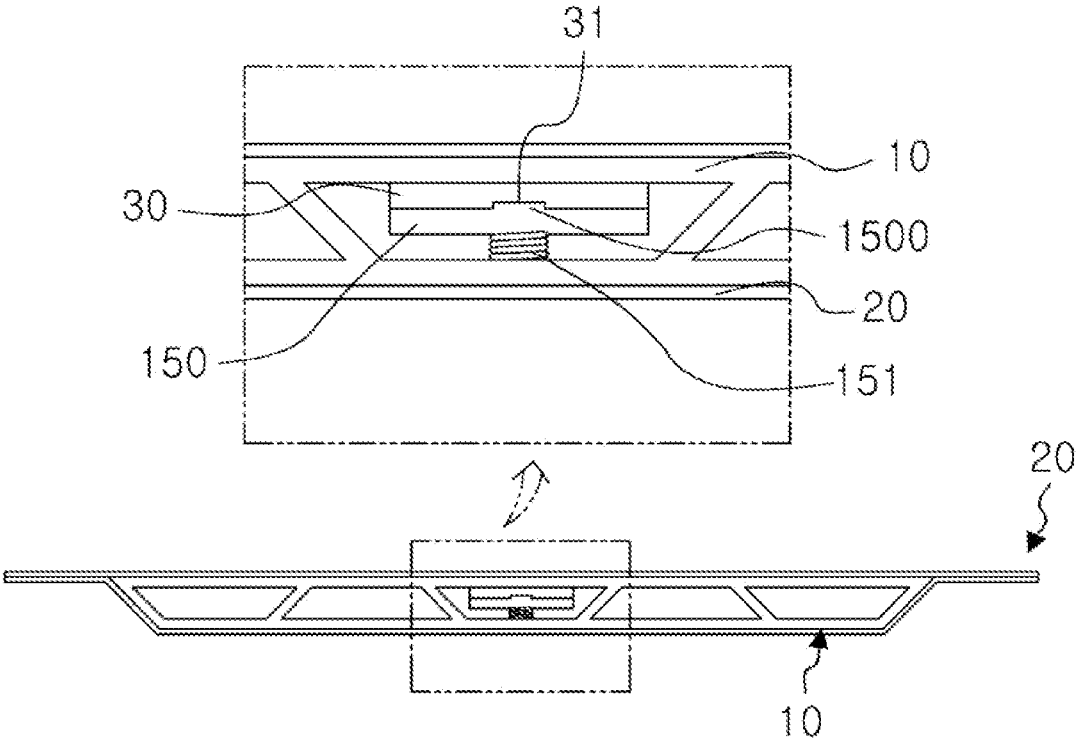

FIGS. 11A and 11B illustrate an example of inserting the connection member in a state when a fixing portion is disposed on the central portion of the composite material reinforcement device according to an embodiment of the present invention. FIGS. 12A and 12B are a projection perspective view and a bottom projection perspective view illustrating a protrusion disposed on a fixing bar of FIG. 11A and a fixing groove disposed in a connection member of FIG. 11B, respectively. FIGS. 13A and 13B are a perspective view illustrating the connection portion inserted into the composite material reinforcement device of FIGS. 12A and 12B and a cross-sectional view of the composite material reinforcement device taken along line A-A'.

Referring to FIGS. 11A to 13B, the central portion 10 of the composite material reinforcement device 1 according to an embodiment of the present invention may further include a fixing portion 15 configured to fix the connection member 30.

The fixing portion 15 may be arranged in a lower portion of the partition space S1 and fixed by pushing the connection member 30 inserted into the partition space S1 from a bottom, and may include a fixing bar 150 and a fixing spring 151.

The fixing bar 150 may be disposed along a length of the partition space S1 so that an upper surface of the fixing bar 150 is in contact with a lower surface of the connection member 30 inserted into the partition space S1. In this case, the fixing bar 150 may be, most preferably, disposed in a position of the connection member 30 inserted into the partition space S1 to have a same length as that of the connection member 30 so that a whole area of the fixing bar 150 is in contact with the connection member 30. However, the fixing bar 150 is not limited thereto.

The fixing spring 151 is arranged on a lower surface of the partition space S1, with an upper end of the fixing spring 151 connected to a lower surface of the fixing bar 150.

In the fixing portion 15, the fixing bar 150 may move upward or downward as the fixing spring 151 is expanded or compressed.

Accordingly, in the fixing portion 15, when the fixing spring 151 is expanded before the connection member 30 is inserted into the partition space S1, the fixing bar 150 may be positioned in an upper portion as shown in FIG. 11A. Then, as the fixing bar 150 is pressed downward, the connection member 30 is inserted into the partition space S1. Upon being completely inserted into the partition space S1, the connection member 30 is positioned to be in contact with the fixing bar 150 as shown in FIG. 11B. In this case, the fixing spring 151 provides support from a lower side when the connection member 30 is in contact with fixing bar 150. Thus, the connection member 30 may be fixed without moving in the partition space S1.

In addition, the fixing bar 150 may be configured such that an upper surface of the end into which the connection member 30 is inserted is diagonally provided. Thus, the insertion of the connection member 30 may be smoothly performed. However, the fixing bar 150 is not limited thereto.

In the fixing portion 15, a protrusion 1500 may be disposed on the fixing bar 150 and a fixing groove may be disposed in the connection member 30 to prevent the connection member 30 from being separated from the partition space S1 and increase fixing force.

Referring to FIG. 12A, the protrusion 1500 may be disposed along a longitudinal direction on an upper surface of the fixing bar 150. It is most preferable to divide the upper surface into a plurality of zones and provide one protrusion to each zone. However, the present invention is not limited thereto. In this case, the protrusion may have various shapes, such as a triangle, a quadrilateral, a circle, etc.

Referring to FIG. 12B, the fixing groove 31 is arranged in a position corresponding to the protrusion 1500 on the lower surface of the connection member 30. As the protrusion 1500 is coupled into the fixing groove 31, fixing power of the connection member 30 with respect to the composite material reinforcement device 1 may be increased.

In addition, the protrusion 1500 may be coupled into the fixing groove 31 in a position corresponding to a desirable insertion length of the connection member 30. Thus, the insertion length of the connection member 30 may be adjusted. Accordingly, when the connection member 30 is inserted into partition spaces S1 located at both sides in the composite material reinforcement device 1, a problem such that the connection member 30 is inserted further into one partition space S1 compared to another one partition space S1 may be resolved.

Figure 14A:
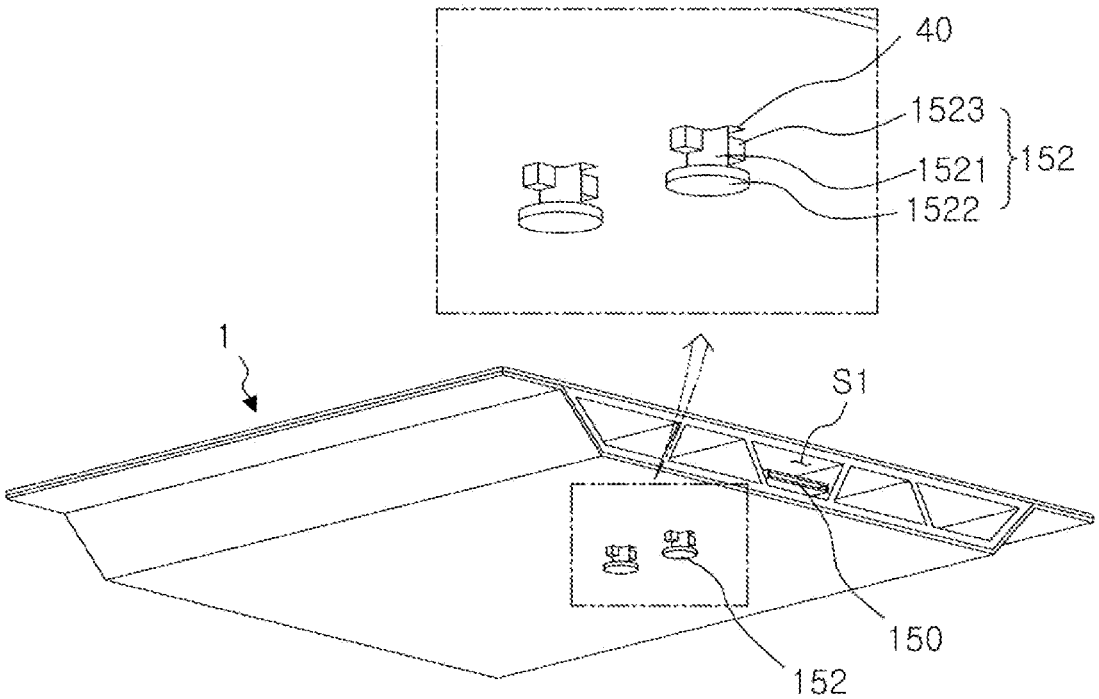
FIGS. 14A and 14B are a bottom perspective view and a lateral cross-sectional view illustrating an upward-and-downward movement portion disposed on the fixing portion of FIGS. 11A and 11B, with a movement member withdrawn from a movement hole.
Figure 14B:
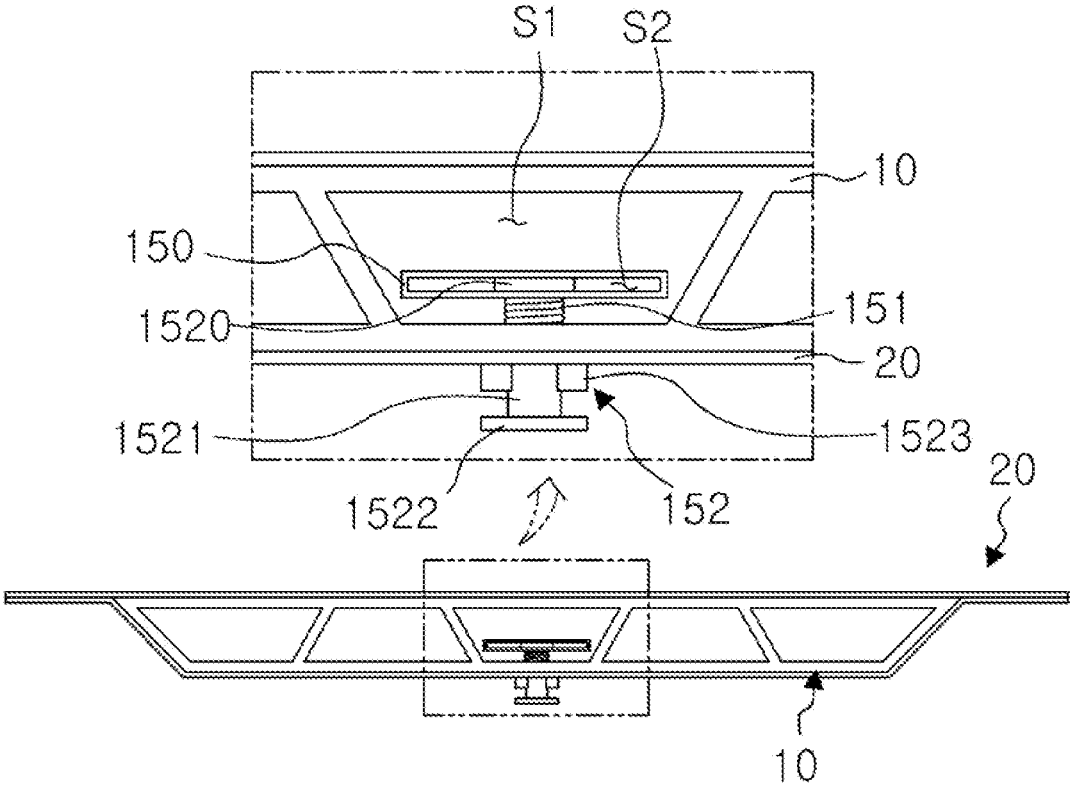
Figure 15A:
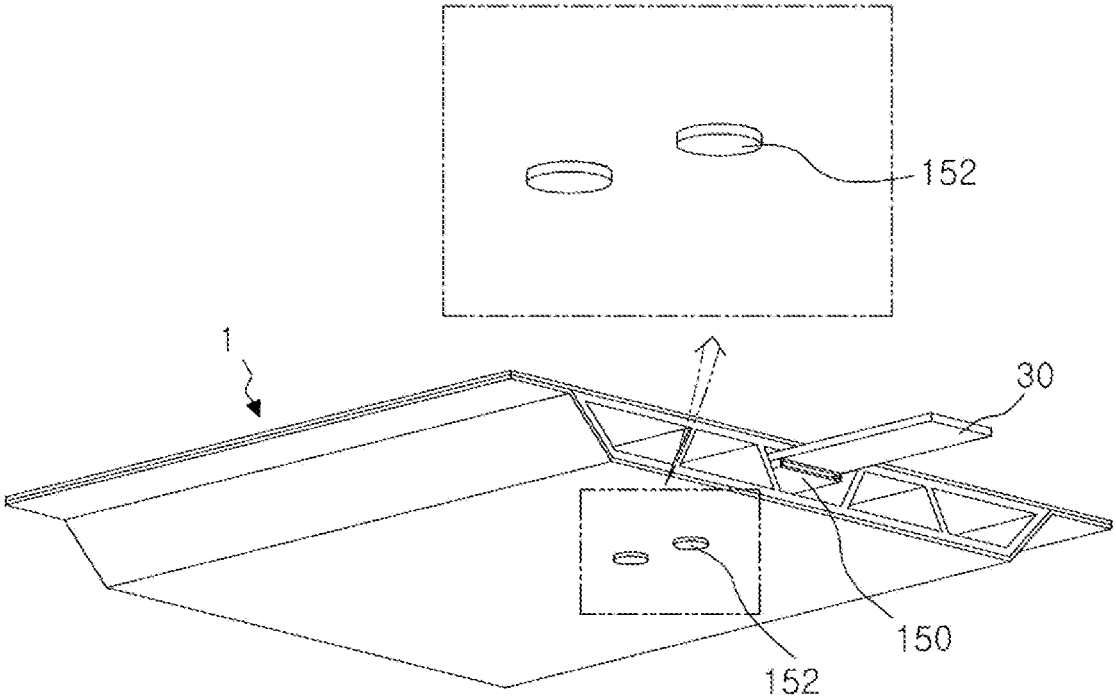
FIGS. 15A and 15B are a bottom perspective view and a lateral cross-sectional view each illustrating the upward-and-downward movement portion disposed on the fixing portion of FIGS. 11A and 11B, with the movement member inserted into the movement hole.
Figure 15B:
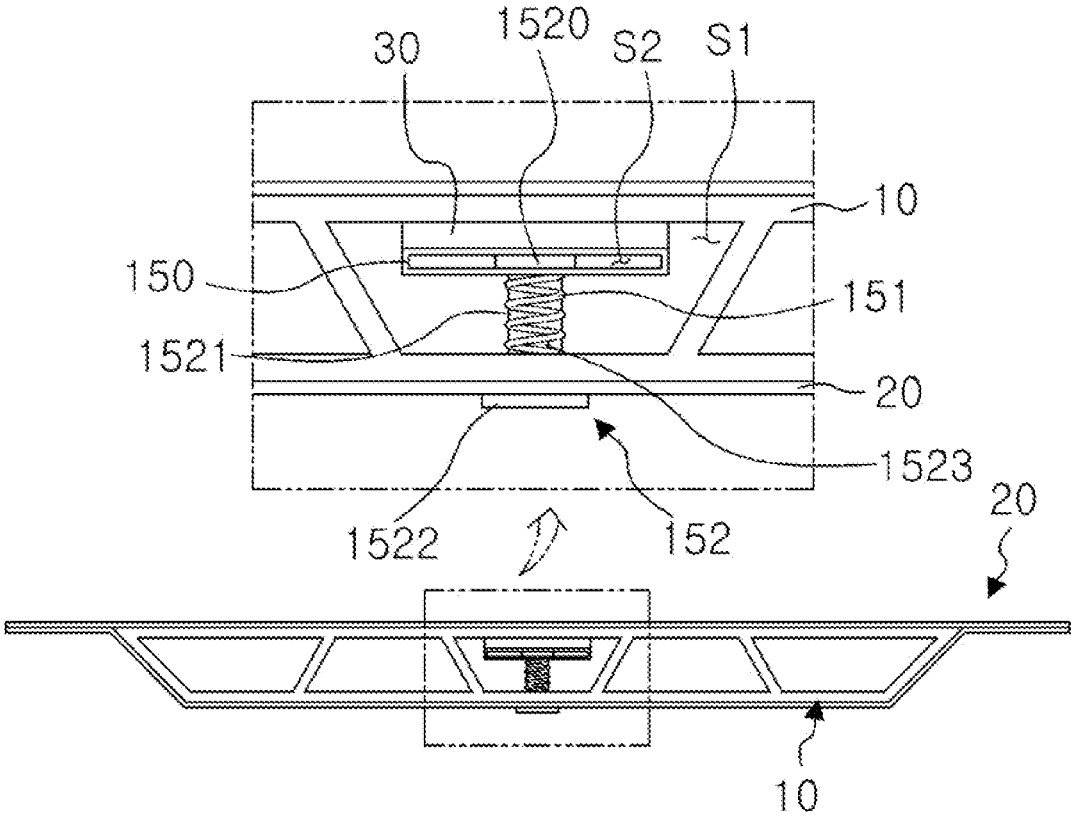
Figure 16A:
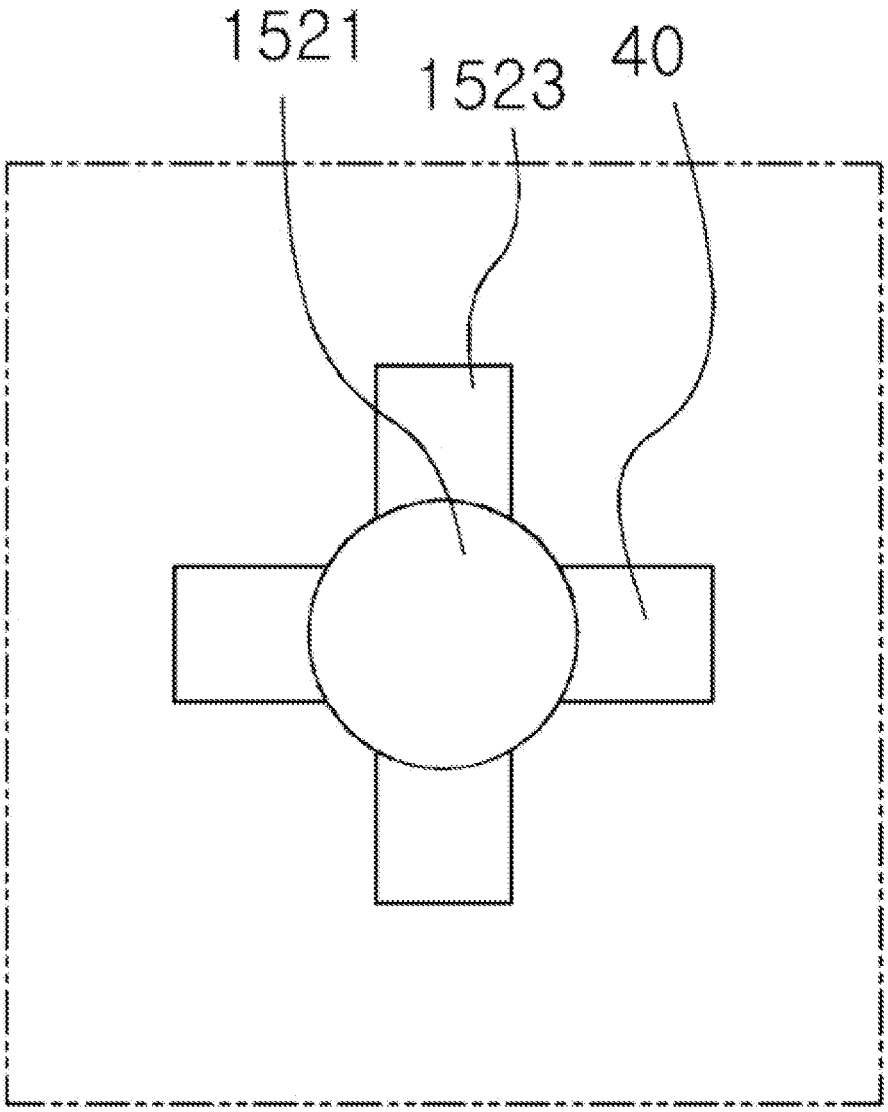
FIGS. 16A and 16B are exemplary bottom plan views illustrating the movement member and the movement hole except for a leg portion of FIGS. 14A to 15B.
Figure 16B:
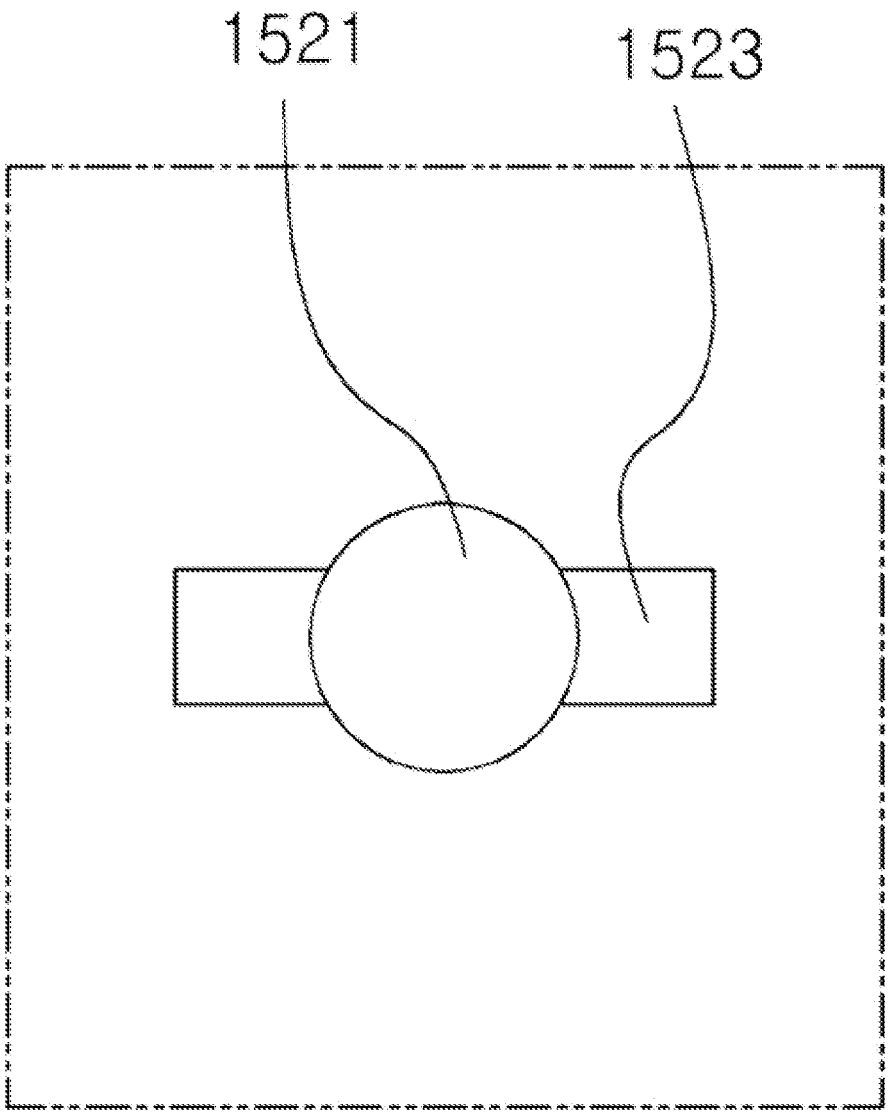

FIGS. 14A and 14B are a bottom perspective view and a lateral cross-sectional view illustrating an upward-and-downward movement portion disposed on the fixing portion of FIGS. 11A and 11B, with a movement member withdrawn from a movement hole. FIGS. 15A and 15B are a bottom perspective view and a lateral cross-sectional view illustrating the upward-and-downward movement portion disposed on the fixing portion of FIGS. 11A and 11B, with the movement member inserted into the movement hole. FIGS. 16A and 16B are exemplary bottom plan views illustrating the movement member and the movement hole except for a leg portion of FIGS. 14A to 15B.

Referring to 14A to 16B, the fixing portion 15 of the composite material reinforcement device 1 according to an embodiment of the present invention may further include the upward-and-downward movement portion configured to adjust a position of the fixing bar 150 so that the connection member 30 is smoothly inserted into the partition space S1.

The upward-and-downward movement portion compresses the fixing spring 151 to fix the fixing bar 150 in a lower position while the connection member 30 is being inserted into an inner space, and expands the fixing spring 151 to have the fixing bar 150 located in an upper position when the connection member 30 is inserted into the partition space S1 to thereby increase fixing force of the connection member 30. The upward-and-downward movement portion may include a movement member 152 and a movement hole 40.

The movement member 152 is arranged on a lower surface of the fixing bar 150 to penetrate through a lower surface of the composite material reinforcement device 1, and may include a head portion 1520, a body portion 1521, a leg portion 1522, and a movement protrusion 1523.

The movement hole 40 may be arranged in a lower surface of the composite material reinforcement device 1 so that the movement member 152 penetrates therethrough.

In this case, the fixing bar 150 may define an inner space S2 of the fixing bar by having a hollow portion therein, but is not limited thereto. A hollow portion may be disposed in only a part of the fixing bar 150 in which the movement member 152 is located.

The head portion 1520 is provided to have a plate shape and is fixedly positioned in the inner space S2 of the fixing bar. The head portion 1520 may have a plate form in various shapes such as a circle, a triangle, a quadrilateral, etc., but is not limited thereto. The head portion 1520 may be provided to be larger than the body portion 1521 to be described later, and thus, fixed in the inner space S2 of the fixing bar. Accordingly, the head portion 1520 is fixedly positioned in the inner space S2 of the fixing bar so that the movement member 152 is connected to the fixing bar 150 without separation.

The body portion 1521 may be provided to have a cylindrical shape on a lower surface of the head portion 1520 and located inside the fixing spring 151. In this case, the body portion 1521 may be provided such that an upper portion penetrates through a lower surface of the fixing bar 150 and a lower portion penetrates through the movement hole 40.

The leg portion 1522 may be provided to have a plate shape on a lower surface of the body portion 1521 and located on a lower surface of the composite material reinforcement device 1. In this case, the leg portion 1522 is provided to be larger than the movement hole 40 not to pass through the movement hole 40, and may have a plate form in various shapes such as a circle, a triangle, a quadrilateral, etc., but is not limited thereto.

The movement protrusion 1523 is provided to protrude outward from both side surfaces of the body portion 1521. The movement protrusion 1523 penetrates through the movement hole 40, and then, rotate to be fixed to a lower surface of the composite material reinforcement device 1. In this case, the movement protrusion 1523 may be provided to have a quadrilateral shape as shown in FIGS. 14A and 14B, and both sides of the movement hole 40 may be preferably provided to have a quadrilateral shape in correspondence with the shape of the movement protrusion 1523.

Hereinafter, an operation of the upward-and-downward movement portion provided as mentioned above is described in detail.

Referring to FIGS. 14A and 14B, before the connection member 30 is inserted into the partition space S1, the movement member 152 is pulled downward. Thus, the fixing spring 151 is compressed, and the fixing bar 150 may be positioned in a state of being pulled downward. In this case, the movement protrusion 1523 may be located on a lower surface of the composite material reinforcement device 1, as shown in FIG. 14A. In detail, referring to FIG. 16A, the movement protrusion 1523 is positioned in a direction perpendicular to the movement hole 40 not to be inserted into the movement hole 40.

In the above-described state, the connection member 30 may be inserted into the partition space S1, and the movement member 152 may be operated as shown in FIGS. 15A and 15B. In detail, the movement member 152 may rotate so that the movement protrusion 1523 is positioned in a same direction as that of the movement hole 40 as shown in FIG. 16B. Thus, the movement protrusion 1523 is inserted into the movement hole 40, and an upper surface of the leg portion 1522 is brought into contact with a lower surface of the composite material reinforcement device 1. Accordingly, the fixing spring 151 is expanded to cause the fixing bar 150 to move upward through the head portion 1520 so that an upper surface of the fixing bar 150 comes into contact with a lower surface of the connection member 30. At this time, the connection member 30 may be pressed and, simultaneously, supported by the fixing bar 150 from a bottom to be brought into a state of being firmly fixed to the composite material reinforcement device 1.

Hereinafter, a method of constructing a composite material reinforcement device applied to the box-type concrete structure 2 is described in detail.

Figure 17:
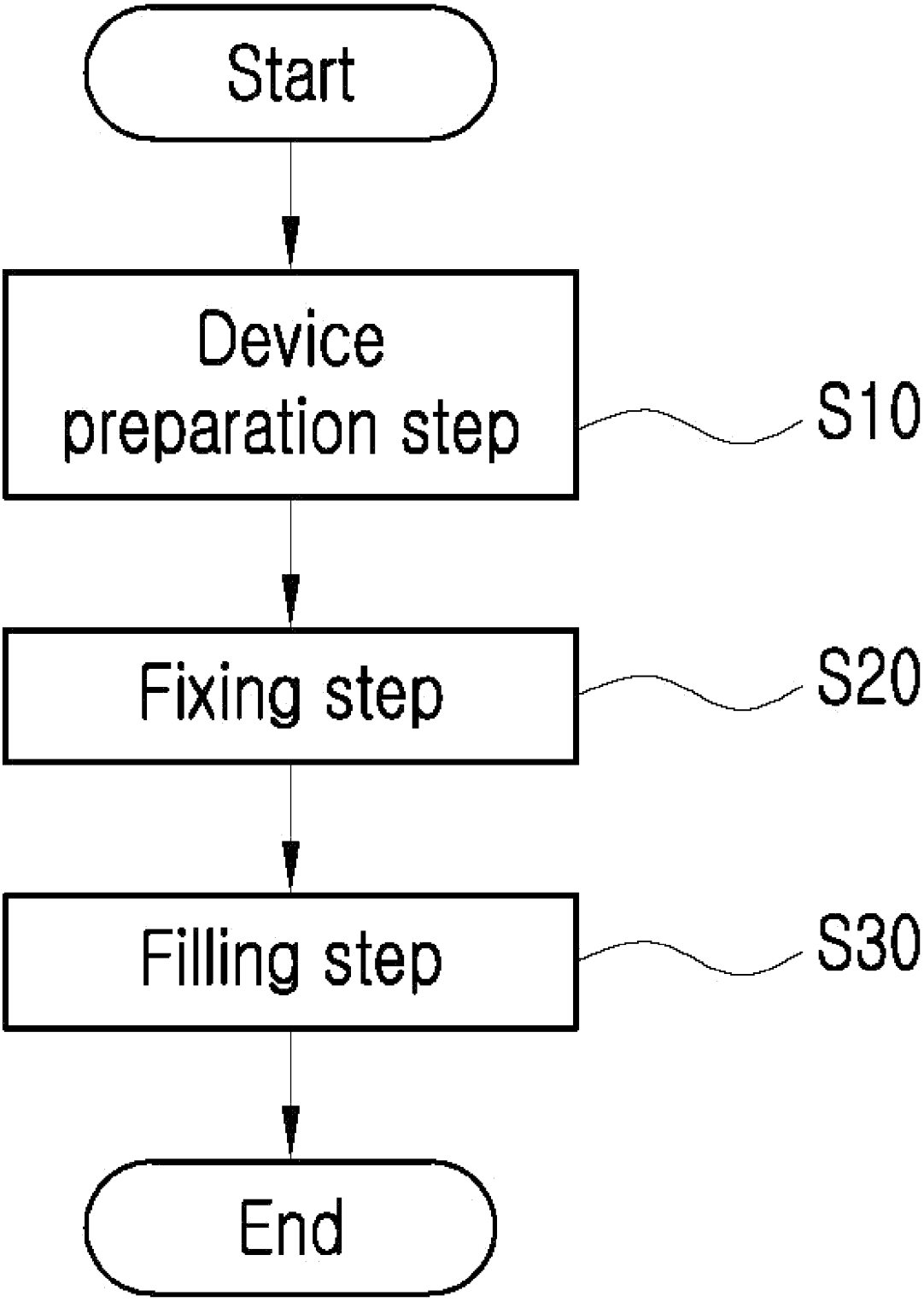
FIG. 17 is a flowchart of a method of constructing the composite material reinforcement device according to an embodiment of the present invention.

FIG. 17 is a flowchart of a construction method for including the composite material reinforcement device according to an embodiment of the present invention.

The construction method for including the composite material reinforcement device 1 according to an embodiment of the present invention relates to a method of constructing the composite material reinforcement device in the box-type concrete structure 2. The construction method includes a device preparation step (S10), a fixing step (S20), and a filling step (S30).

First, the device preparation step (S10) is a step of preparing one or more composite material reinforcement devices 1 to be installed in the box-type concrete structure 2. A specific description of the composite material reinforcement device 1 was described above with respect to the device. Thus, a described description thereof will not be provided again here.

As described above, the composite material reinforcement device 1 may be integrally manufactured by performing molding at a high temperature and under high pressure in a state when the first plate 21 and the second plate 22 cover an upper portion and a lower portion with the central portion 10 arranged at a center and are bonded to each other in the extension portion 23.

At this time, a molding temperature may be 145 to 155° C. and the pressure may be 8 to 10 kgf/cm$^2$. The molding temperature may be, most preferably, 150° C. and the pressure may be 9 kgf/cm$^2$, but are not limited thereto. When the temperature or the pressure is less than the lower limit described above, the composite material reinforcement device 1 may not be properly molded and the central portion 10 may be separated from the reinforcement portion 20. When the temperature or the pressure exceeds the upper limit described above, a problem in durability of the reinforcement portion 20 may occur. Thus, these cases are not desirable.

The fixing step (S20) is a step of fixing the composite material reinforcement device 1 to the box-type concrete structure 2 using an anchor. In detail, in the fixing step (S20), concrete chipping work may be performed on a construction surface and the composite material reinforcement device 1 may be placed in a corresponding location. At this time, the composite material reinforcement device 1 may be positioned in a state when an upper surface of the first plate 21 is in contact with the construction surface. Then, an anchor may be installed to penetrate through the construction surface from a lower surface of the extension portion 23 of the composite material reinforcement device 1. In this case, a plurality of anchors are installed in a portion of the extension of the composite material reinforcement device 1 along a longitudinal direction to firmly fix the composite material reinforcement device 1 to the construction surface.

Then, the filling step (S30) is a step of filling an inner space of the composite material reinforcement device 1 with a reinforcing material. In this case, various materials filled through foaming, such as urethane foam, may be used as the reinforcing material. Strength of the composite material reinforcement device 1 may be increased by filling the partition spaces S1 with the reinforcing agent. Most preferably, according to positions of the partition spaces S1, a central part thereof may be filled with rigid urethane foam having high strength, and both end parts thereof may be filled with light-weight flexible urethane foam. However, the present invention is not limited thereto. As such, strength may be reinforced while a light weight is maintained by using rigid or flexible urethane foam depending on positions of the partition spaces S1.

The construction method of the composite material reinforcement device 1 according to an embodiment of the present invention may further include a bending forming step after the device preparation step (S10).

The bending formation step is a step of bending the composite material reinforcement device 1 with reference to the cutting line 24 to extend the composite material reinforcement device 1 from the corner B to the slab A of the box-type concrete structure 2. A detailed description thereof was provided above, and thus, will not be provided again here.

As such, in the bending forming step, as the composite material reinforcement device 1 bent with reference to the cutting line 24 is positioned sequentially from the slab A to the corner B, an effect of shear reinforcement may be increased.

In addition, the construction method of constructing the composite material reinforcement device 1 according to an embodiment of the present invention may further include a connection step after the device preparation step (S10).

The connection step is a step of inserting the connection member 30 into the partition spaces S1 by connecting a plurality of composite material reinforcement devices to each other in a longitudinal direction to be extended in the longitudinal direction. In detail, in the connection step, the connection member may be coupled between an end of one composite material reinforcement device 1 and an end of another composite material reinforcement device to be inserted into one of partition spaces S1 of the central portion 10 of each of the composite material reinforcement device 1 to thereby allow the composite material reinforcement device 1 to be extended in a longitudinal direction.

While the present invention has been particularly shown and described with reference to exemplary embodiments thereof, it will be understood by those of ordinary skill in the art that various changes in form and details may be made therein without departing from the spirit and scope of the present invention as defined by the following claims. Accordingly, the concept of the present invention must not be confined to the explained embodiments, and the following patent claims as well as everything including variations equal or equivalent to the patent claims pertain to the category of the concept of the present invention.

EXPLANATION OF REFERENCE NUMERALS

1: composite material reinforcement device
10: central portion
11: edge portion
12: partition wall portion
15: fixing portion
150: fixing bar
1500: protrusion
151: fixing spring
152: movement member
1520: head portion
1521: body portion
1522: leg portion
1523: movement protrusion
20: reinforcement portion
21: first plate
22: second plate
23: extension portion
24: cutting line
30: connection member
31: fixing groove
40: movement hole
2: box-type concrete structure
A: slab
B: corner
S1: partition space
S2: fixing bar inner space

The invention claimed is:

1. A composite material reinforcement device for reinforcing earthquake resistance of a closed polygonal concrete structure, the composite material reinforcement device comprising:

a central portion comprising an edge portion having an inner space therein, wherein the inner space has a trapezoidal-shaped cross-section with reference to a longitudinal direction; and a partition wall portion dividing the inner space into at least one partition space;

a reinforcement portion disposed on a top and a bottom of the central portion and integrally formed to cover the central portion; and a connection member configured to connect a pair of composite material reinforcement devices to each other in the longitudinal direction, wherein the reinforcement portion comprises:

a first plate disposed on the top of the central portion to cover an upper portion of the central portion;

a second plate having a shape corresponding to a shape of the central portion and disposed at the bottom of the central portion to cover a lower portion of the central portion; and an extension portion in which the first plate and the second plate extend from both ends of the central portion to be bonded to each other, wherein the connection member has a bar shape and is configured to be coupled between an end of one composite material reinforcement device and an end of another composite material reinforcement device and to be inserted into one of the at least one partition space of the central portion of each of the pair of composite material reinforcement devices, wherein the central portion further comprises a fixing portion disposed in a lower portion of the at least one partition space and configured to fix the connection member, and wherein the fixing portion comprises:

a fixing bar disposed along a length in the at least one partition space, wherein upper surface of the fixing bar is in contact with the connection member; and a plurality of fixing springs disposed on a lower surface of the at least one partition space, wherein upper ends of the plurality of fixing springs are connected to a lower surface of the fixing bar.

2. The composite material reinforcement device of claim 1, wherein the composite material reinforcement device is configured to be installed by inserting an anchor into the extension portion when an upper surface of the first plate is in contact with a part of the closed polygonal concrete structure, the part being vulnerable to vibration.

3. The composite material reinforcement device of claim 1, wherein the second plate comprises a cutting line disposed on a lower surface thereof, and wherein the composite material reinforcement device is configured to be bent with reference to the cutting line and to be installed in a bent portion of the closed polygonal concrete structure.

4. The composite material reinforcement device of claim 1, wherein the central portion is made of an aluminum alloy, and wherein the reinforcement portion comprises a prepreg sheet provided by impregnating a thermosetting resin into a fiber sheet including at least one of carbon fiber and glass fiber.

5. The composite material reinforcement device of claim 1, the composite material reinforcement device comprises a plurality of the central portion.

6. The composite material reinforcement device of claim 1, wherein the fixing bar is divided into a plurality of zones on the upper surface thereof along the longitudinal direction and a fixing protrusion is disposed on each of the plurality of zones, and wherein the connection member has at least one fixing groove disposed on a lower surface thereof in correspondence with the fixing protrusion of the fixing bar to couple the fixing protrusion into the at least one fixing groove, thereby increasing fixing power of the connection member with respect to the composite material reinforcement device.

7. The composite material reinforcement device of claim 1, wherein the fixing portion further comprises an upward-and-downward movement portion configured to increase fixing power of the connection member by either compressing the plurality of fixing springs to fix the fixing bar in a lower portion of the fixing portion or expanding the plurality of fixing springs to fix the fixing bar in an upper portion of the fixing portion, and wherein the upward-and-downward movement portion comprises:

a movement member disposed on the lower surface of the fixing bar to penetrate through a lower surface of the composite material reinforcement device; and a movement hole disposed in the lower surface of the composite material reinforcement device, and the movement member is configured to penetrate through the movement hole.

8. The composite material reinforcement device of claim 7, wherein the fixing bar includes a hollow portion therein defining an inner space, and wherein the movement member comprises:

a head portion having a plate shape and disposed in the inner space of the fixing bar;

a body portion having a cylindrical shape and disposed on a lower surface of the head portion, wherein the body portion is disposed inside one of the plurality of fixing springs such that an upper side of the body portion penetrates through the lower surface of the fixing bar and a lower side of the body portion penetrates through the movement hole;

a leg portion provided having a plate form and disposed on a lower surface of the body portion, wherein the leg portion is disposed on the lower surface of the composite material reinforcement device; and a movement protrusion disposed on a side surface of the body portion and configured to penetrate through the movement hole, and then, rotate to be fixed to the lower surface of the composite material reinforcement device.

* * * * *